US009896284B2

(12) United States Patent
Yang et al.

(10) Patent No.: US 9,896,284 B2
(45) Date of Patent: Feb. 20, 2018

(54) SHEET MATERIAL FEEDING DEVICE AND IMAGE FORMING APPARATUS

(71) Applicant: KONICA MINOLTA, INC., Chiyoda-ku, Tokyo (JP)

(72) Inventors: Shuan Yang, Kariya (JP); Junichi Tanimoto, Toyokawa (JP); Yuki Doshida, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/486,066

(22) Filed: Apr. 12, 2017

(65) Prior Publication Data

US 2017/0313528 A1 Nov. 2, 2017

(30) Foreign Application Priority Data

Apr. 28, 2016 (JP) ..... 2016-090035

(51) Int. Cl.

| | |
|---|---|
| ***B65H 1/26*** | (2006.01) |
| ***B65H 1/14*** | (2006.01) |
| ***B65H 9/04*** | (2006.01) |
| ***G03G 15/00*** | (2006.01) |

(52) U.S. Cl.

CPC ..... *B65H 1/14* (2013.01); *B65H 1/266* (2013.01); *B65H 9/04* (2013.01); *G03G 15/6529* (2013.01); *B65H 2801/06* (2013.01)

(58) Field of Classification Search

CPC . B65H 1/12; B65H 1/14; B65H 1/266; B65H 2405/112; B65H 2405/1122; B65H 2405/1124; B65H 2405/31; B65H 2405/32

See application file for complete search history.

(56) References Cited

U.S. PATENT DOCUMENTS

| | | | | |
|---|---|---|---|---|
| 4,280,692 A * | 7/1981 | Hutchinson | B65H 1/04 271/127 |
| 5,419,544 A * | 5/1995 | Ono | B65H 1/04 271/157 |
| 6,916,019 B2 | 7/2005 | Takahashi | |
| 8,770,578 B2 * | 7/2014 | Yamamoto | B65H 1/266 271/171 |
| 9,561,917 B2 * | 2/2017 | Morizono | B65H 1/04 |
| 2017/0275114 A1 * | 9/2017 | Matsui | B65H 1/12 |

FOREIGN PATENT DOCUMENTS

JP 2004142892 A 5/2004

* cited by examiner

*Primary Examiner* — Michael C McCullough
(74) *Attorney, Agent, or Firm* — Holtz, Holtz & Volek PC

(57) ABSTRACT

A sheet material feeding device includes: a housing; a cassette configured to accommodate a sheet material therein and capable of being pulled out of the housing; a pushing-up plate which is on the cassette and configured to fluctuate and a position thereof is changed to a feeding position or a retracted position; a rear-end regulating member for regulating a position of an upstream end of the sheet material; a rear-end displacement member which is supported by the rear-end regulating member and configured to fluctuate and a position thereof is changed to a feeding position or a retracted position; a pushing-up plate displacing device configured to change the position of the pushing-up plate to the feeding position; and a rear-end displacement member displacing device configured to complete a position change of the rear-end displacement member to the feeding position before a position change of the pushing-up plate to the feeding position.

13 Claims, 24 Drawing Sheets

SHEET MATERIAL FEEDING DEVICE AND IMAGE FORMING APPARATUS

The entire disclosure of Japanese Patent Application No. 2016-090035 filed on Apr. 28, 2016 including description, claims, drawings, and abstract are incorporated herein by reference in its entirety.

BACKGROUND OF THE INVENTION

Field of the Invention

The present invention relates to a sheet material feeding device and an image forming apparatus provided with the same.

Description of the Related Art

Image forming apparatuses such as copying machines, printers, and facsimiles include a sheet material feeding device that feeds sheet materials such as paper sheets. The sheet material feeding device includes a rear-end regulating member for regulating the position of the upstream end (rear end) of the sheet material in the feeding direction inside the cassette accommodating the sheet materials. Furthermore, in order to achieve a stable feeding corresponding to a change in the posture of the sheet materials as the number of sheet materials inside the cassette is decreased by feeding, a rear-end displacement member that comes in pressure contact with the sheet materials from the upstream side to the downstream side in the feeding direction may be provided.

In the case of this sheet material feeding device, there is concern that the rear-end displacement member becomes an obstacle at the time of replenishing the sheet materials to the cassette or that the sheet material bends when a small number of sheet materials are replenished. Therefore, in order to solve these problems, a technique has been proposed in which the rear-end displacement member is displaced to the upstream side in the feeding direction when the cassette is pulled out of the housing unit. An example of a prior art of such a sheet material feeding device is disclosed in JP 2004-142892 A.

The sheet material feeding device described in JP 2004-142892 A includes an end fence (rear-end regulating member), a pressing member (rear-end displacement member) projecting downstream in the feeding direction from the end fence, an urging member for urging the pressing member toward the downstream side in the feeding direction, and an urging force switching device for switching between presence and absence of urging force by the urging member corresponding to push-in and pull-out of the cassette with respect to the predetermined position. In this sheet material feeding device, the urging force of the pressing member by the urging device is applied by pushing the cassette to a predetermined position, and the urging force of the pressing member by the urging device is not allowed to be applied by pulling out the cassette from the predetermined position.

However, in the sheet material feeding device described in JP 2004-142892 A, there is a problem that the timing of the operations between the bottom plate (pushing-up plate) for pushing the sheet material upward and the pressing member (rear-end displacement member) is not mentioned. For example, when the urging timing for the sheet material to the downstream side in the feeding direction by the pressing member is later than the timing of pushing up the sheet material by the bottom plate, there is a possibility that the downstream end (leading edge) of the sheet material in the feeding direction is displaced to the upstream side according to the upward displacement of the bottom plate in the case where a small number of sheet materials are supplied to the cassette. As a result, contact between the uppermost sheet material and a feeding device becomes poor, and the sheet material may be bent by being urged toward the downstream side in the feeding direction by the pressing member. As a result, there is a concern that misfeed and skew feeding (inclination) of the sheet material may occur.

SUMMARY OF THE INVENTION

The present invention has been made in view of the above-described problems, and an object of the present invention is to provide a sheet material feeding device and an image forming apparatus capable of achieving a stable feeding in response to a change in the posture of sheet materials as the number of the sheet materials inside the cassette is reduced by feeding.

To achieve the abovementioned object, according to an aspect, a sheet material feeding device reflecting one aspect of the present invention comprises: a housing; a cassette configured to accommodate a sheet material therein and capable of being pulled out of the housing and being stored in the housing; a pushing-up plate which is disposed on an inner bottom surface of the cassette and configured to fluctuate in a vertical direction with the sheet material placed on an upper surface of the pushing-up plate and a position thereof is changed to a feeding position or a retracted position; a rear-end regulating member provided inside the cassette for regulating a position of an upstream end of the sheet material in a feeding direction of the sheet material; a rear-end displacement member which is supported by the rear-end regulating member and configured to fluctuate in the feeding direction of the sheet material and a position thereof is changed to a feeding position or a retracted position; a pushing-up plate displacing device configured to change the position of the pushing-up plate to the feeding position when the cassette is stored in the housing; and a rear-end displacement member displacing device configured to complete a position change of the rear-end displacement member to the feeding position before a position change of the pushing-up plate to the feeding position by the pushing-up plate displacing device when the cassette is stored in the housing.

According to this configuration, the timing of changing the position of the rear-end displacement member to the feeding position of the sheet material when the cassette is stored in the housing unit is earlier than the timing of position change of the pushing-up plate to the feeding position of the sheet material. As a result, regardless of the number of the sheet materials inside the cassette, the sheet materials are disposed at a proper position with respect to the feeding direction. Therefore, stable feeding is achieved.

According to the sheet material feeding device with the above configuration, after the position change of the rear-end displacement member to the feeding position by the rear-end displacement member displacing device is completed, the position change of the pushing-up plate to the feeding position by the pushing-up plate displacing device is preferably started.

According to the sheet material feeding device with the above configuration, the sheet material feeding device preferably further comprises an electric drive source configured to change the position of the pushing-up plate.

According to the sheet material feeding device with the above configuration, the sheet material feeding device preferably further comprises an electric drive source configured to change the position of the rear-end displacement member.

According to the sheet material feeding device with the above configuration, the pushing-up plate displacing device preferably changes the position of the pushing-up plate by a mechanism that does not obtain power from an electric drive source.

According to the sheet material feeding device with the above configuration, the rear-end displacement member displacing device preferably changes the position of the rear-end displacement member by a mechanism that does not obtain power from an electric drive source.

According to the sheet material feeding device with the above configuration, the pushing-up plate displacing device preferably changes the position of the pushing-up plate to the retracted position when the cassette is pulled out of the housing.

According to the sheet material feeding device with the above configuration, the rear-end displacement member displacing device preferably changes the position of the rear-end displacement member to the retracted position when the cassette is pulled out of the housing.

According to the sheet material feeding device with the above configuration, the rear-end displacement member displacing device preferably comprises a first starting lever configured to change the position of the rear-end displacement member to the feeding position by coming into contact with the housing so as to be displaced when the cassette is stored in the housing.

According to the sheet material feeding device with the above configuration, the pushing-up plate displacing device preferably comprises a second starting lever configured to change the position of the pushing-up plate to the feeding position by coming into contact with the housing so as to be displaced when the cassette is stored in the housing.

According to the sheet material feeding device with the above configuration, a first starting lever preferably comes in contact with the housing before the second starting lever comes in contact with the housing.

According to the sheet material feeding device with the above configuration, a first starting lever and the second starting lever are preferably formed as a single member.

To achieve the abovementioned object, according to an aspect, an image forming apparatus reflecting one aspect of the present invention comprises: the sheet material feeding device with the above configuration; and an image forming unit configured to form an image on a sheet supplied from the sheet material feeding device.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First Embodiment

Figure 1:
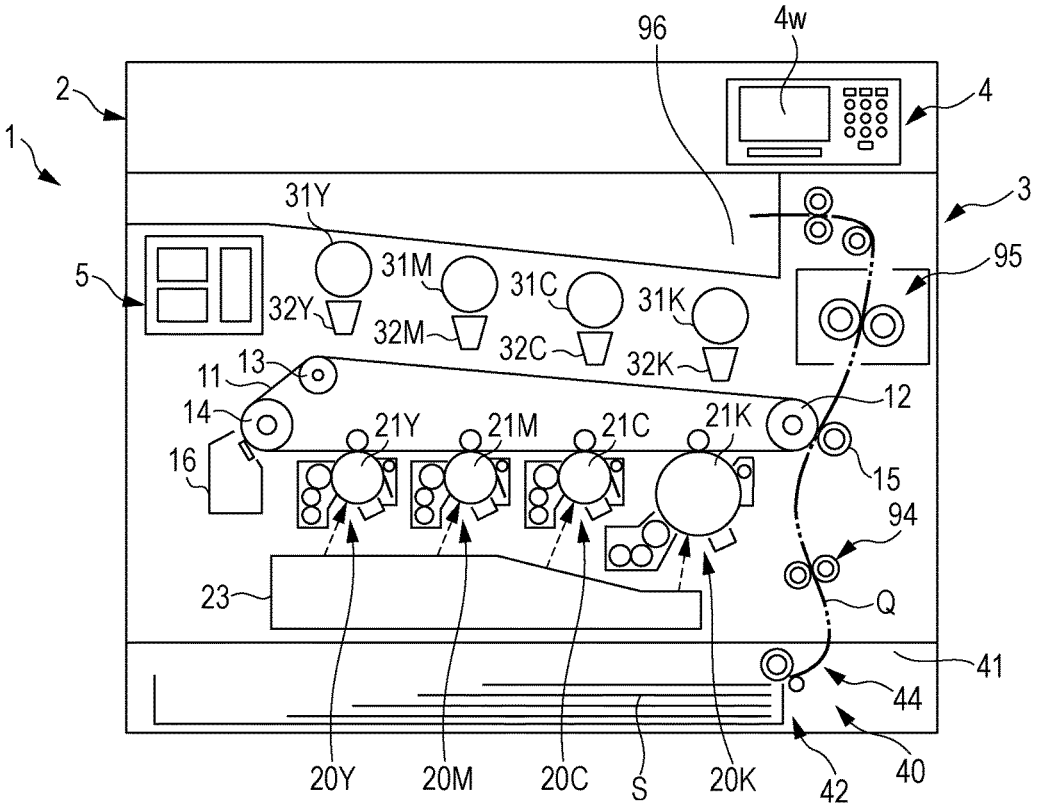
FIG. 1 is a partial vertically cross-sectional front view of an image forming apparatus according to a first embodiment of the present invention.

First, the image output operation of the image forming apparatus according to a first embodiment of the present invention will be described while roughly describing structure thereof with reference to FIG. 1. FIG. 1 is an example of a partial vertically cross-sectional front view of the image forming apparatus. In addition, the two-dot chain line with an arrow in the figure indicates a conveyance path and a conveyance direction of the sheet material.

As shown in FIG. 1, an image forming apparatus 1 is a so-called tandem type color copying machine, and includes an image reading unit 2 for reading an image of a document, a printing unit 3 for printing the read image on a sheet material such as a paper sheet, an operation unit 4 for inputting printing conditions and displaying the operation status, and a main control unit 5.

The image reading unit 2 is a known one that reads an image of a document placed on the upper surface of a platen glass (not shown) by moving a scanner (not shown). The image on the document is separated into three colors of red (R), green (G), and blue (B), and is converted into electric signals by a charge coupled device (CCD) image sensor (not shown). As a result, the image reading unit 2 obtains image data of each color of red (R), green (G), and blue (B).

The image data of each color obtained by the image reading unit 2 is subjected to various processes in a main control unit 5 to be converted into image data of each reproduction color of yellow (Y), magenta (M), cyan (C), and black (K) and stored in a memory (not shown) of the main control unit 5. The image data for each reproduction color stored in the memory is subjected to processing for correction of misregistration, and then read out for each scanning line in synchronism with the conveyance of the sheet material in order to perform light beam scanning with respect to a photosensitive drum 21 serving as an image carrying member.

The printing unit 3 forms an image by the electrophotographic method and transfers the image to the sheet material. The printing unit 3 includes an intermediate transfer belt 11 which is formed as an endless belt of an intermediate transfer body. The intermediate transfer belt 11 is wound around a driving roller 12, tension roller 13 and follower roller 14. Tension is applied to the intermediate transfer belt 11 by the tension roller 13 being urged upward by a spring (not shown) in FIG. 1. The intermediate transfer belt 11 rotates counterclockwise in FIG. 1 by the driving roller 12.

The driving roller 12 is in pressure contact with an opposed secondary transfer roller 15 with the intermediate transfer belt 11 interposed therebetween. At the position of the follower roller 14, an intermediate transfer cleaning unit 16 provided so as to face the follower roller 14 with the intermediate transfer belt 11 interposed therebetween is in contact with the outer peripheral surface of the intermediate transfer belt 11. After the toner image formed on the outer peripheral surface of the intermediate transfer belt 11 is transferred to the sheet material S, the intermediate transfer cleaning unit 16 removes deposits such as toner remaining on the outer peripheral surface of the intermediate transfer belt 11 to clean the belt.

Image forming units 20Y, 20M, 20C, and 20K corresponding to the reproduction colors of yellow (Y), magenta (M), cyan (C), and black (K) are provided under the intermediate transfer belt 11. Hereinafter, unless restriction is particularly necessary, the description of the identification marks of "Y", "M", "C", and "K" may be omitted and "image forming unit 20" may be used generically for example. The four image forming units 20 are arranged in a row along the rotating direction of the intermediate transfer belt 11 from the upstream side to the downstream side. The four image forming units 20 have the same configuration, and a charging unit, an exposure unit, a developing unit, a drum cleaning unit, and a primary transfer roller are arranged around the photosensitive drum 21 rotating clockwise in FIG. 1.

A scanning optical device 23, which is an exposure device, is disposed below the image forming units 20. The scanning optical device 23 serves as one unit for the four image forming units 20 and has light sources such as four semiconductor lasers (not shown) or the like corresponding to the four photosensitive drums 21 respectively. The scanning optical device 23 modulates the four semiconductor laser beams in accordance with the image gradation data of each reproduction color and emits the laser beams corresponding to reproduction colors to the four photosensitive drums 21 respectively.

Above the intermediate transfer belt 11, toner bottles 31 and toner hoppers 32 are provided corresponding to the image forming units 20 of the four reproduction colors respectively. For the developing unit and the toner hopper 32, a residual quantity detection unit (not shown) for detecting the remaining amount of toner in each of them is provided. Further, toner replenishing devices (not shown) are provided between the developing unit and the toner hopper 32 and between the toner hopper 32 and the toner bottle 31 respectively. When the residual quantity detection unit detects a decrease in the remaining amount of the toner in the developing unit, the replenishing device drives to replenish the toner from the toner hopper 32 to the developing unit. Further, when the residual quantity detection unit detects a decrease in the remaining amount of the toner inside the toner hopper 32, the replenishing device drives to replenish the toner from the toner bottle 31 to the toner hopper 32. The toner bottle 31 is detachably provided to the apparatus body, and can be replaced with a new one as appropriate.

Below the scanning optical device 23, there is provided a sheet material feeding device 40 that accommodates a plurality of sheet materials S such as sheets of paper or the like therein. The sheet materials S accommodated inside the sheet material feeding device 40 is fed out one by one to the sheet material conveyance path Q from the uppermost layer by a feeding unit 44. The sheet material S delivered from the sheet material feeding device 40 to the sheet material conveyance path Q reaches the position of a pair of registration rollers 94. The pair of registration rollers 94 sends out the sheet material S toward the contact portion between the intermediate transfer belt 11 and the secondary transfer roller 15 (secondary transfer nip portion) in synchronism with the rotation of the intermediate transfer belt 11 while correcting the skew feeding of the sheet material S (skew correction).

In the image forming unit 20, an electrostatic latent image is formed on the surface of the photosensitive drum 21 by the laser beam emitted from the scanning optical device 23, and the electrostatic latent image is visualized as a toner image by the developing unit. The toner image formed on the surface of the photosensitive drum 21 is primarily transferred onto the outer peripheral surface of the intermediate transfer belt 11 at a position where the photosensitive drum 21 faces the primary transfer roller with the intermediate transfer belt 11 interposed therebetween. While the intermediate transfer belt 11 rotates, the toner images of the respective image forming units 20 are sequentially transferred onto the intermediate transfer belt 11 at a predetermined timing, whereby a color toner image is formed by superimposing four toner colors of yellow, magenta, cyan, black on each other on the outer peripheral surface of the intermediate transfer belt 11.

The color toner image primarily transferred onto the outer peripheral surface of the intermediate transfer belt 11 is transferred onto the sheet material S fed in synchronism by the pair of registration rollers 94 at the secondary transfer nip portion formed by contact between the intermediate transfer belt 11 and the secondary transfer roller 15.

A fixing unit 95 is provided above the secondary transfer nip portion. The sheet material S onto which the unfixed toner image has been transferred at the secondary transfer nip portion is sent to the fixing unit 95 and is sandwiched between a heating roller and a pressure roller, and the toner image is heated and pressed to be fixed to the sheet material S. The sheet material S that has passed through the fixing unit 95 is discharged to a sheet material discharge unit 96 provided above the intermediate transfer belt 11.

The operation unit 4 is provided on the front side of the image reading unit 2. The operation unit 4 accepts a setting input of printing conditions by a user such as the type and size of the sheet material S to be used for printing, enlargement/reduction and presence or absence of duplex printing, and a setting input of a facsimile number, a sender name, etc. in facsimile transmission. In addition, the operation unit 4 also functions as an informing unit for notifying the user about the status of the apparatus, notes, error messages, for example by display on the display unit 4w.

Further, the image forming apparatus 1 is provided with the main control unit 5 constituted by a CPU (not shown), an image processing unit, and other electronic components (not shown) so as to control the overall operation thereof. The main control unit 5 achieves a series of image forming operations and printing operations by using the CPU serving as a central processing unit and the image processing unit so as to control constituent elements such as the image reading unit 2 and the printing unit 3 on the basis of programs and data stored or input in the memory.

Figure 2:
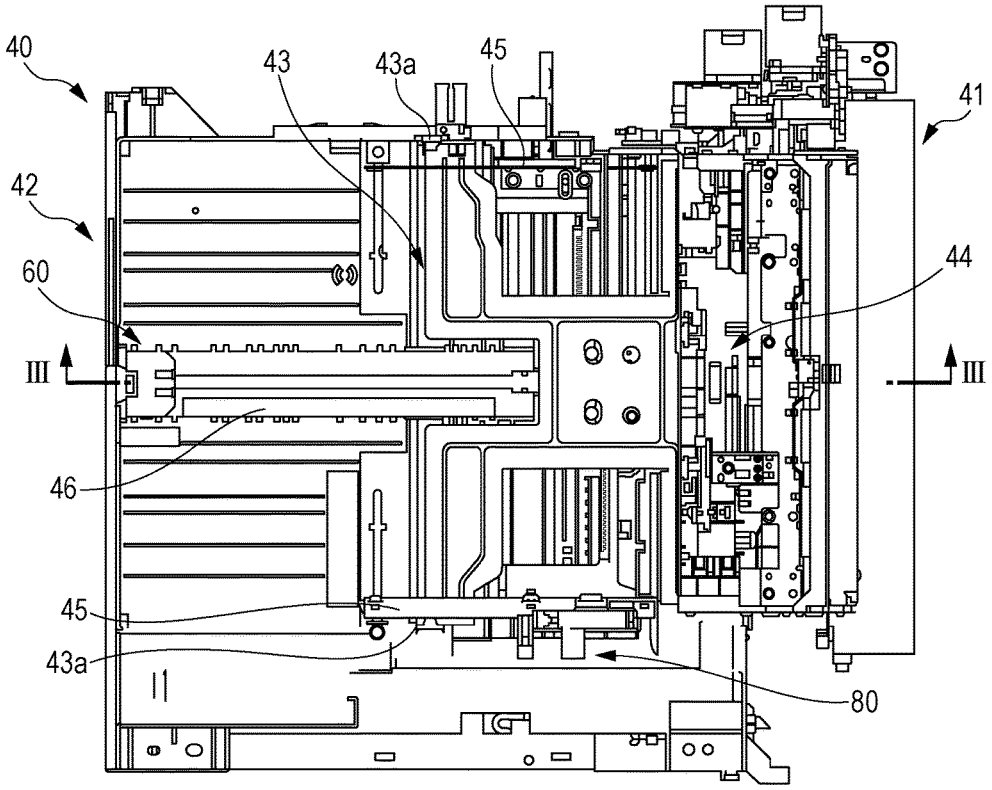
FIG. 2 is a top view of a sheet material feeding device of the image forming apparatus according to the first embodiment of the present invention.
Figure 3:
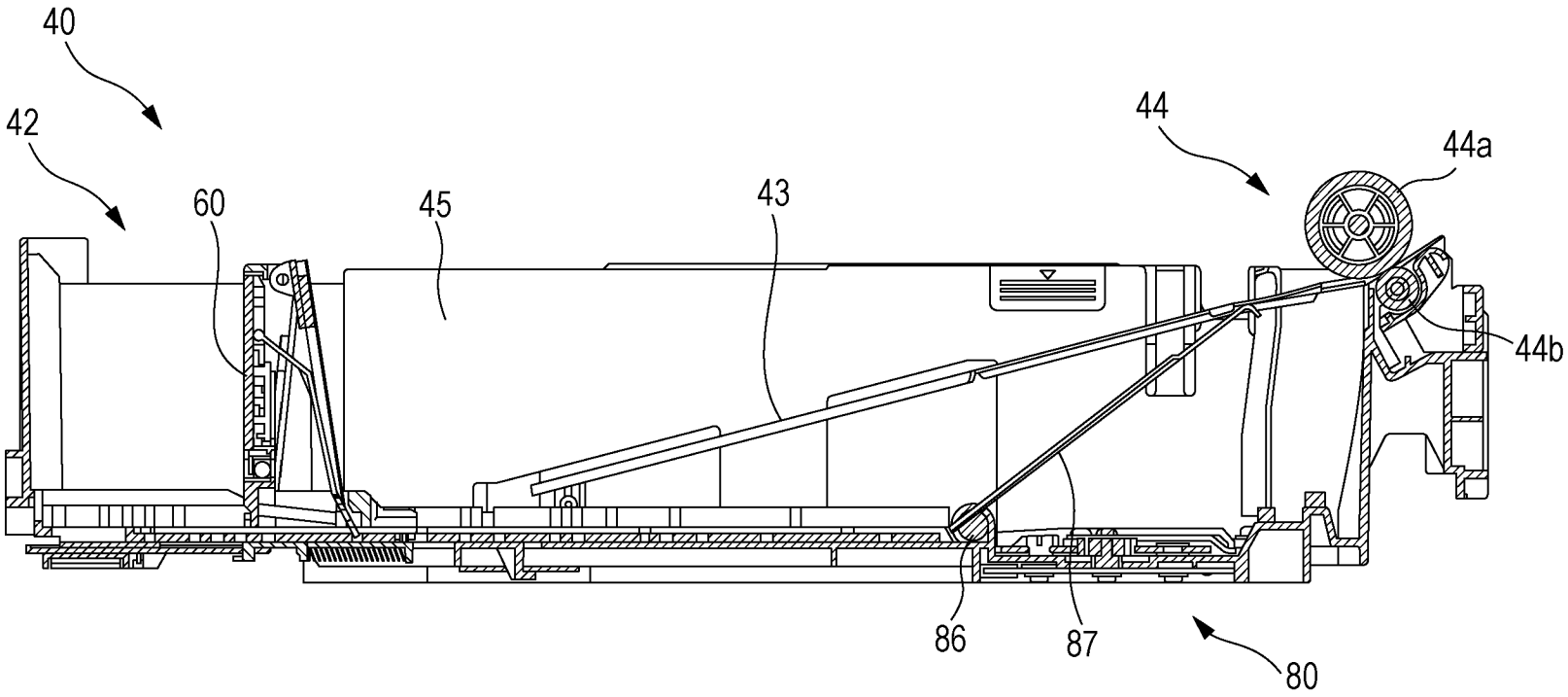
FIG. 3 is a vertical cross-sectional front view of the sheet material feeding device of the image forming apparatus according to the first embodiment of the present invention.
Figure 4:
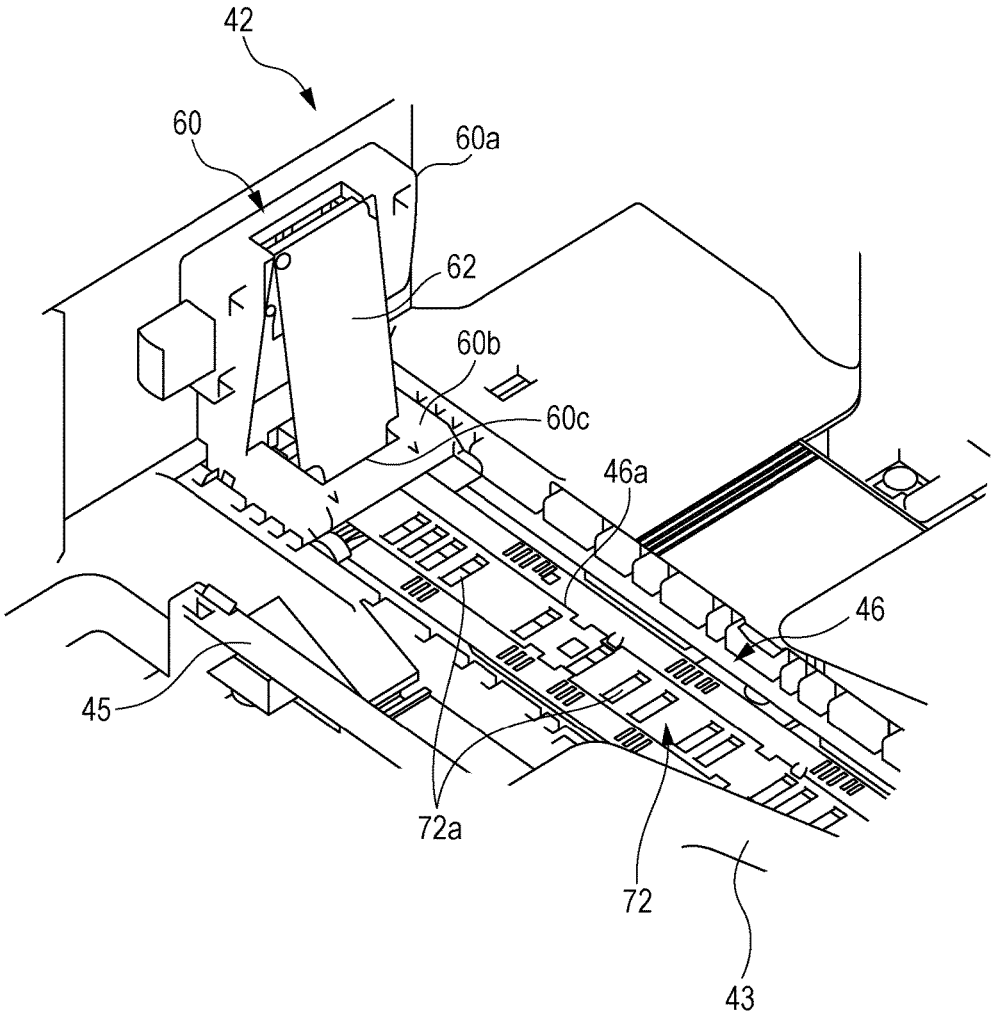
FIG. 4 is a partially enlarged perspective view of a cassette of the sheet material feeding device according to the first embodiment of the present invention.
Figure 5:
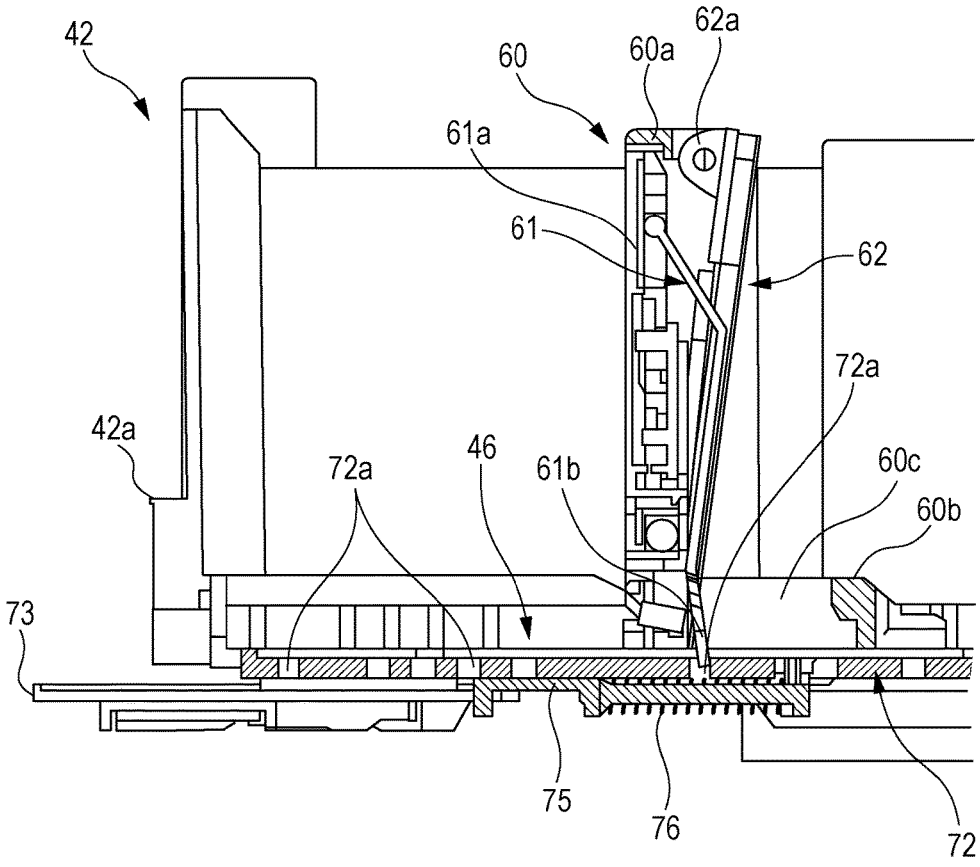
FIG. 5 is a partially enlarged vertical cross-sectional front view of the cassette of the sheet material feeding device according to the first embodiment of the present invention when the cassette has been pulled out.

Next, the configuration of the sheet material feeding device 40 of the image forming apparatus 1 will be described with reference to FIGS. 2 to 5. FIGS. 2 and 3 are a top view and a vertical cross-sectional front view of the sheet material feeding device 40. FIG. 4 is a partially enlarged perspective view of the cassette of the sheet material feeding device 40. FIG. 5 is a partially enlarged vertical cross-sectional front view of the cassette of the sheet material feeding device 40 when the cassette has been pulled out. FIG. 3 is a vertical cross-sectional view taken along the line III-III drawn in FIG. 2, and drawings around the rear-end regulating member which will be described later is omitted. The lower side of FIG. 2 is the front side of the sheet material feeding device 40, and the upper side of FIG. 2 is the back side of the sheet material feeding device 40. The top and bottom direction in FIG. 3 is the vertical direction of the sheet material feeding device 40, and the right and left direction in FIG. 3 is the right and left direction of the sheet material feeding device 40.

The sheet material feeding device 40 includes a housing unit 41 and a cassette 42 as shown in FIGS. 2 and 3. The cassette 42 is a sheet material accommodating unit in which sheet materials such as cut paper or the like before printing are stacked and accommodated. The cassette 42 is formed in a flat box shape with the upper face opened, and the sheet materials are stored and stacked in a direction from the upper face. The sheet material is fed toward the right in FIGS. 2 and 3 with respect to the cassette 42 by the operation of the feeding unit 44 which will be described in detail later.

The cassette 42 can be slid horizontally with respect to the housing unit 41 along a guide portion (not shown) provided to extend in the front-back direction between the cassette 42 and the housing unit 41. The cassette 42 can be pulled out of and stored in the housing unit 41 by pulling out or pushing in the front-back direction.

A pushing-up plate 43 is disposed on the inner bottom surface of the cassette 42. The sheet materials are placed and stacked up on the pushing-up plate 43. The pushing-up plate 43 is supported on side walls inside the cassette 42 by support shafts 43*a* provided so as to extend in the front-back direction at the upstream end thereof in the sheet material feeding direction, that is, the left end in FIG. 2. The pushing-up plate 43 is swingable around the support shaft 43*a* vertically in a vertical plane with the downstream end (right end) in the sheet material feeding direction being a free end, and the inclination angle of the feeding direction of the sheet material changes according to the stacking number of the sheet materials stacked on the top surface. The support shafts 43*a* are provided at two places, that is the front side and the back side of the pushing-up plate 43.

On the lower side of the downstream side of the pushing-up plate 43 in the sheet material feeding direction, a pushing-up plate displacing device 80 to be described later is arranged between the pushing-up plate 43 and the inner bottom surface of the cassette 42 and on the front side of the pushing-up plate 43 and further on the outer bottom surface of the cassette 42 (see FIGS. 9 and 10). When the cassette 42 is stored in the housing unit 41, the pushing-up plate displacing device 80 operates and the downstream portion of the pushing-up plate 43 in the sheet material feeding direction rises. When the cassette 42 is pulled out of the housing unit 41, the pushing-up plate displacing device 80 operates and the pushing-up plate 43 falls down to the inner bottom surface of the cassette 42. In this way, the pushing-up plate displacing device 80 changes the position of the pushing-up plate 43.

The feeding unit 44 is disposed on the housing unit 41 above the downstream portion of the cassette 42 in the sheet material feeding direction. The feeding unit 44 feeds the sheet material accommodated inside the cassette 42 to the outside of the cassette 42. The feeding unit 44 includes a feeding roller 44*a* and a separating roller 44*b* shown in FIG. 3.

The feeding roller 44*a* is disposed above the downstream portion of the pushing-up plate 43 in the sheet material feeding direction. When the downstream portion in the sheet material feeding direction of the sheet materials stacked on the pushing-up plate 43 is pushed up by the pushing-up plate 43, the uppermost layer of the sheet materials comes in pressure contact with the feeding roller 44*a* from below. The sheet material S in the cassette 42 is sent to the outside of the cassette 42 by the feeding roller 44*a*.

The lower part of the surface of the feeding roller 44*a* is provided so as to protrude toward the sheet material conveyance path Q extending from the sheet material feeding device 40 to the outside thereof. The feeding roller 44*a* is connected to a motor (not shown) and rotated.

The separating roller 44*b* is disposed below the feeding roller 44*a* facing the separating roller across the sheet material conveyance path Q. The separating roller 44*b* is in pressure contact with the feeding roller 44*a* by the action of a urging member (not shown). The sheet material is inserted into the nip portion formed by contact between the separating roller 44*b* and the feeding roller 44*a*. The separating roller 44*b* is not connected to a motor but is rotated in accordance with the rotation of the feeding roller 44*a* by the contact with the feeding roller 44*a*.

For example, a torque limiter (not shown) is provided on the shaft portion of the separating roller 44*b*. When a sheet material does not exist in or only one sheet material has entered the nip portion formed by contact between the separating roller 44*b* and the feeding roller 44*a*, a torque equal to or larger than the setting torque of the torque limiter is applied to the separating roller 44*b* and the separating roller 44*b* rotates in the direction for feeding the sheet material in accordance with the feeding roller 44*a*. On the other hand, when a plurality of sheets enter the nip portion due to overlapping of the sheet materials, the torque applied to the separating roller 44*b* is less than the setting torque of the torque limiter and the separating roller 44*b* stops the rotation. As a result, since the lower side of the overlapped lower sheet materials is not fed out, occurrence of the problem of double feeding in which overlapped sheet materials are sent can be prevented.

Width regulating members 45 are disposed at both ends of the sheet materials stacked on the pushing-up plate 43 in the cassette 42 in a direction intersecting the feeding direction, that is, on the front side and the back side of the sheet materials. The width regulating members 45 are displaceable in the width direction of the sheet material which is a direction intersecting the sheet material feeding direction and can be brought into contact with the end face on the front side and the end face on the back side of a bundle of the sheet materials. As a result, the width regulating member 45 regulates the position in the width direction of the sheet material.

A rear-end regulating member 60 is disposed on the upstream side in the feeding direction of the sheet materials stacked on the pushing-up plate 43 inside the cassette 42. One rear-end regulating member 60 is provided at the center portion in the width direction of the sheet material, which is a direction intersecting the feeding direction of the sheet material. The rear-end regulating member 60 is displaceable in parallel to the sheet material feeding direction and can be brought into contact with an end surface (rear end) of the bundle of sheet materials on the upstream side in the feeding direction. As a result, the rear-end regulating member 60 regulates the position of the upstream end of the sheet material in the feeding direction.

Figure 6:
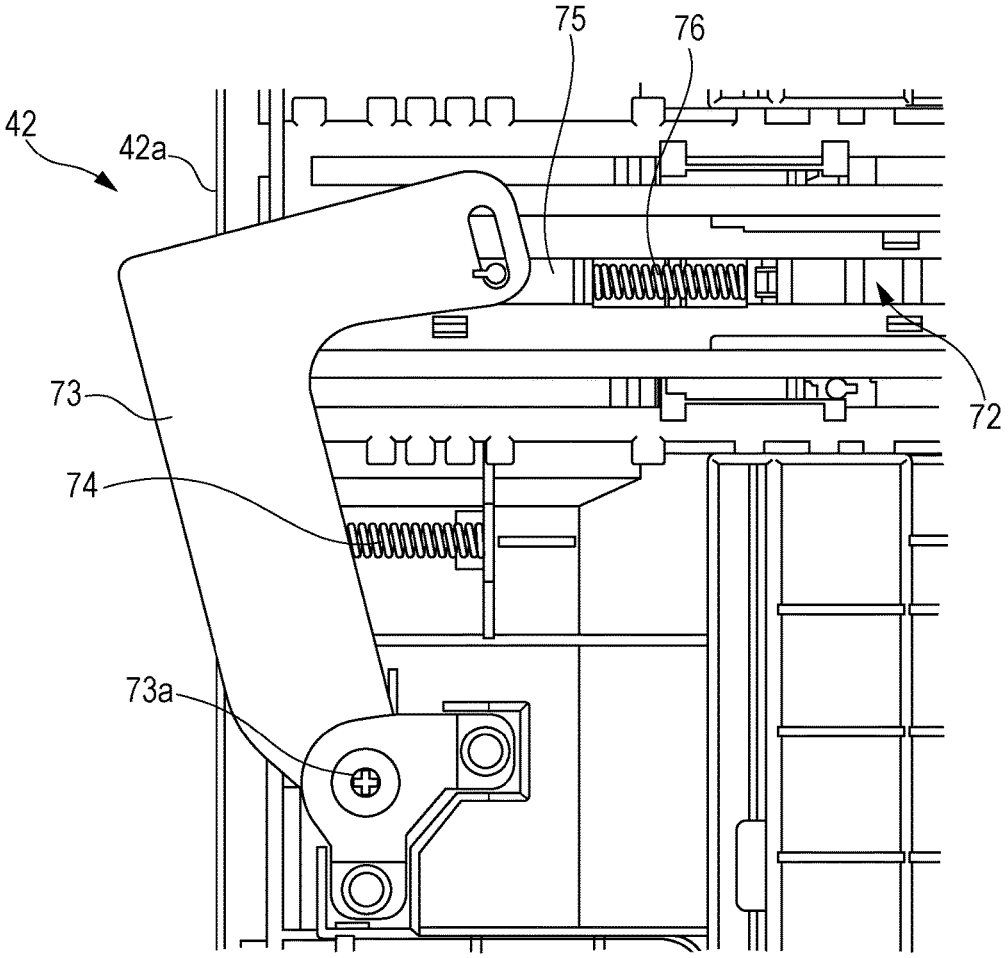
FIG. 6 is a partially enlarged bottom view of the cassette of the sheet material feeding device according to the first embodiment of the present invention when the cassette has been pulled out.
Figure 7:
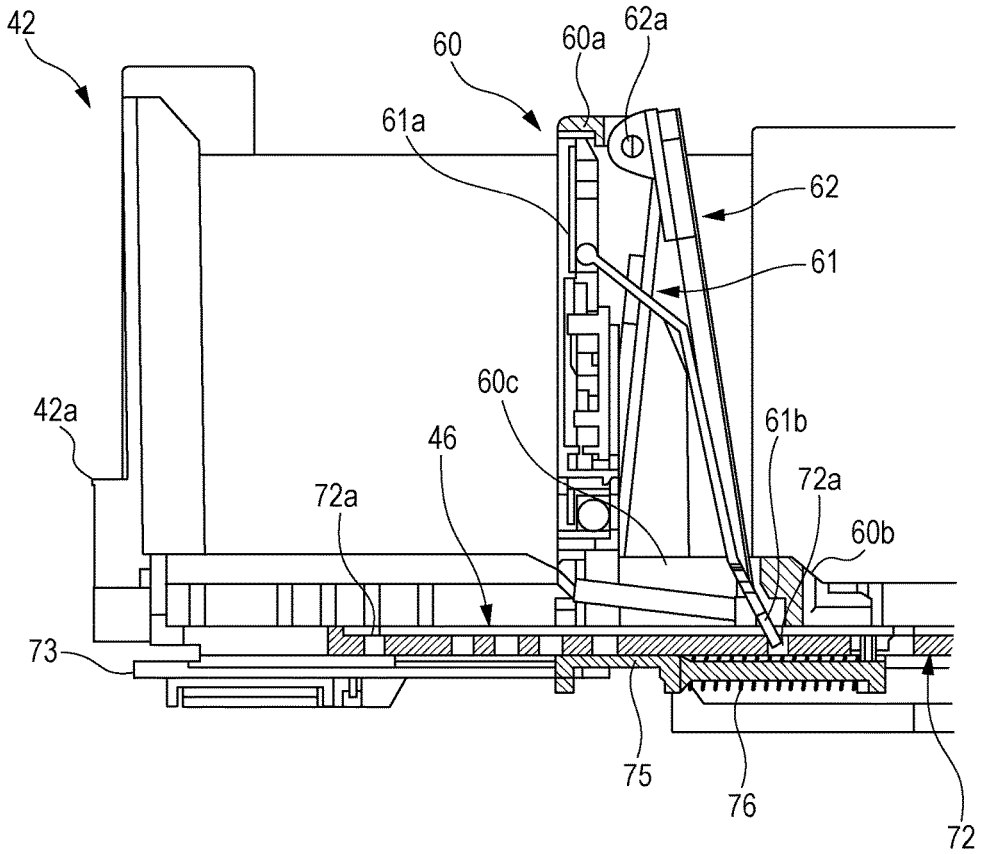
FIG. 7 is a partially enlarged vertical cross-sectional front view of the cassette of the sheet material feeding device according to the first embodiment of the present invention when the cassette is stored.
Figure 8:
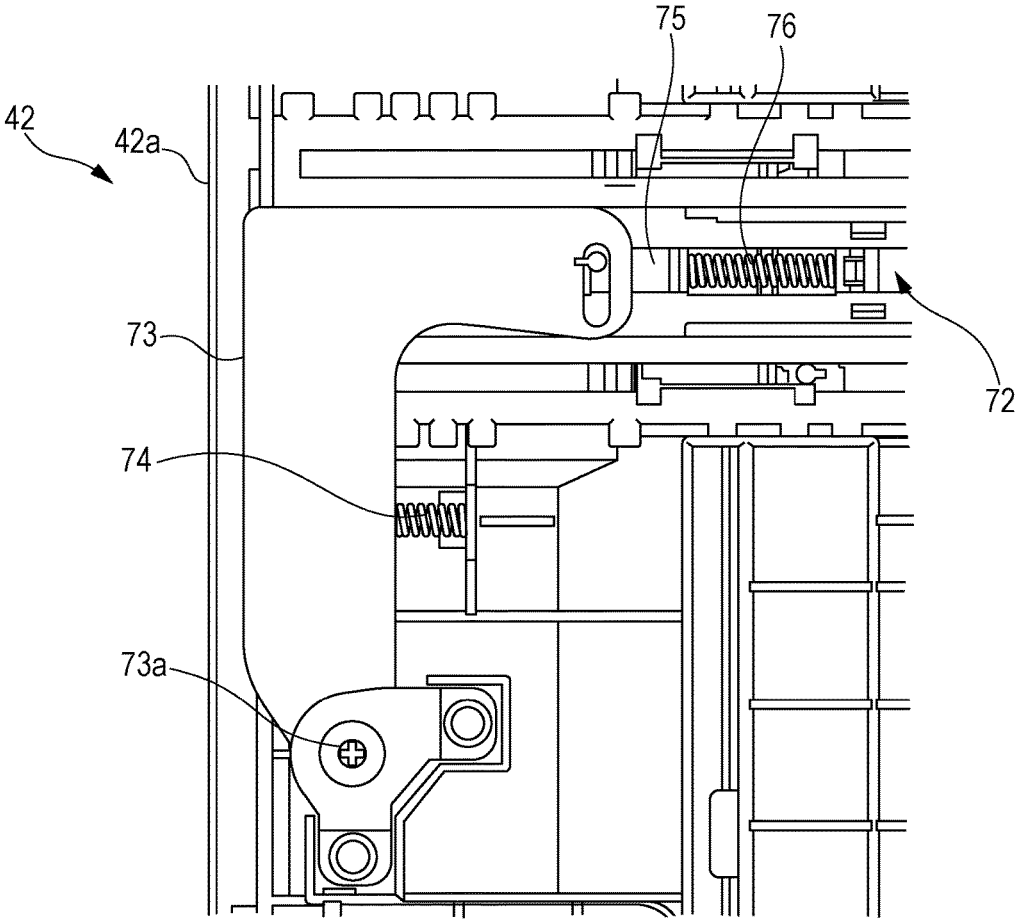
FIG. 8 is a partially enlarged bottom view of the cassette of the sheet material feeding device according to the first embodiment of the present invention when the cassette is stored.

Next, the structures of the rear-end regulating member 60 and its surroundings will be described with reference to FIGS. 6 to 8 in addition to FIGS. 2, 4, and 5. FIG. 6 is a partially enlarged bottom view of the cassette 42 when the cassette has been pulled out. FIGS. 7 and 8 are partially enlarged vertical cross-sectional front view and partially enlarged bottom view of the cassette 42 when the cassette 42 is stored.

As shown in FIGS. 4 and 5, the rear-end regulating member 60 is a member an outer shape of which is L-shaped viewed from the front, and includes a vertical portion 60*a* and a horizontal portion 60*b*. The vertical portion 60*a* and the horizontal portion 60*b* do not need to be strictly vertical and horizontal.

The vertical portion 60*a* is formed so as to be substantially vertical extending upward from the inner bottom surface of the cassette 42. The horizontal portion 60*b* is formed so as to be substantially horizontal extending from the lower portion of the vertical portion 60*a* along the inner bottom surface of the cassette 42 toward the downstream side in the feeding direction of the sheet material. The horizontal portion 60*b* is fitted to a guide rail 46 provided on the inner bottom surface of the cassette 42. The guide rail 46 extends in parallel to the feeding direction of the sheet material. The rear-end regulating member 60 can move in parallel to the sheet material feeding direction via the guide rail 46.

The rear-end regulating member 60 includes a rear-end displacement member 61 and a rear-end contact member 62. The rear-end displacement member 61 and the rear-end contact member 62 each form a plate shape extending in the width direction of the sheet material and substantially vertically. The rear-end displacement member 61 and the rear-end contact member 62 are supported on the upper portion of the vertical portion 60*a* via support shaft portions 61*a* and 62*a* provided at the upper ends of the members and extending substantially horizontally in the width direction of the sheet material respectively. The rear-end displacement member 61 and the rear-end contact member 62 are rotatable around the axis of the support shaft portions 61*a* and 62*a* respectively, and the lower portions thereof are swung in the feeding direction of the sheet material. As shown in FIG. 5, the support shaft portion 61*a* of the rear-end displacement member 61 and the support shaft portion 62*a* of the rear-end contact member 62 are provided at different positions.

Both lower ends of the rear-end displacement member 61 and the rear-end contact member 62 are inserted into an opening 60*c* which passes through the horizontal inner side of the horizontal portion 60*b* in the vertical direction. The lower end portion of the rear-end contact member 62 does not protrude downward from the bottom surface of the horizontal portion 60*b* but a lower end portion 61*b* of the rear-end displacement member 61 protrudes downward from the bottom surface of the horizontal portion 60*b*.

The rear-end contact member 62 is interposed between the rear-end displacement member 61 and the upstream end of the sheet material in the feeding direction, and directly comes in contact with the upstream end of the sheet material in the feeding direction. The rear-end contact member 62 is displaced in the sheet material feeding direction together with displacement of the rear-end displacement member 61 in the sheet material feeding direction.

A rear-end displacement member displacing device 70 is provided on the bottom of the cassette 42 around the rear-end regulating member 60. As shown in FIGS. 4 to 6, the rear-end displacement member displacing device 70 includes a slide member 72, first starting lever 73, first starting lever urging spring 74, connecting piece 75, and slide member urging spring 76.

The slide member 72 is provided on the outer bottom portion of the cassette 42. The slide member 72 is disposed at the center portion of the guide rail 46 in the width direction of the sheet material. The slide member 72 has a relatively elongated plate shape extending along the bottom surface of the cassette 42 and extends parallel to the direction in which the guide rail 46 extends, that is, in the feeding direction of the sheet material.

The upper portion of the slide member 72 is fitted into an opening groove 46*a* provided in the bottom portion of the guide rail 46, passing through vertically and extending in parallel in the feeding direction of the sheet material, and the upper surface of the slide member 72 faces the inside of the cassette 42. The slide member 72 can slide in a direction in which the opening groove 46*a* extends, that is, in parallel to the feeding direction of the sheet material.

The slide member 72 is fitted into the opening groove 46*a* and has engaging portions 72*a* in a region where the upper surface of the slide member 72 faces the inside of the cassette 42. The engaging portion 72*a* is formed as a long hole having a rectangular shape for example, and a plurality of the engaging portions 72*a* corresponding to the types of the sizes of the sheet material in the feeding direction are arranged side by side in the feeding direction of the sheet material. As shown in FIGS. 5 and 7, the lower end portion 61*b* of the rear-end displacement member 61 protruding downward from the bottom surface of the horizontal portion 60*b* of the rear-end regulating member 60 is engaged with the engaging portion 72*a*.

The first starting lever 73 is provided at the outer bottom portion of the cassette 42 and below the slide member 72. The first starting lever 73 has a plate shape extending along the bottom surface of the cassette 42, and its outer shape is substantially L-shaped as viewed from below. The first starting lever 73 is supported on the outer bottom surface of the cassette 42 via a vertically extending support shaft portion 73*a* provided at one end of the first starting lever 73. The support shaft portion 73*a* is provided on the back side (the lower side in FIG. 6) of the center portion in the width direction of the sheet material in the cassette 42 and the first starting lever 73 extends toward the front side (the upper side in FIG. 6) from the support shaft portion 73*a*. The first starting lever 73 is rotatable around the axis of the support shaft portion 73*a*.

The first starting lever urging spring 74 is disposed radially outward around the axis of the support shaft portion 73*a* of the first starting lever 73. The first starting lever 73 is urged by the first starting lever urging spring 74 in the rotational direction around the axis of the support shaft portion 73*a*. The first starting lever urging spring 74 is, for example, constituted by a compression coil spring and extends in parallel to the feeding direction of the sheet material and is disposed between the bottom portion of the cassette 42 and the first starting lever 73. As a result, when the cassette 42 has been pulled out of the housing unit 41, a part of the first starting lever 73 protrudes outward from an outer wall surface 42*a* on the upstream side of the cassette 42 in the feeding direction of the sheet material as shown in FIGS. 5 and 6.

The connecting piece 75 and the slide member urging spring 76 are disposed below the slide member 72 and are provided so as to be movable in parallel to the feeding direction of the sheet material similarly to the slide member 72. The other end (free end) of the first starting lever 73 and the slide member 72 are connected via the connecting piece 75 and the slide member urging spring 76. The slide member urging spring 76 is, for example, constituted by a compression coil spring and disposed between the connecting piece 75 and the slide member 72 so that the axis thereof extends in parallel to the feeding direction of the sheet material, and elastic force acts along the feeding direction of the sheet material.

When the cassette 42 is stored in the housing unit 41, the first starting lever 73 comes in contact with the inner wall of the housing unit 41. As shown in FIGS. 7 and 8, the first starting lever 73 retracts entirely inside the outer wall surface 42*a* on the upstream side of the cassette 42 in the feeding direction of the sheet material while resisting the urging force of the first starting lever urging spring 74. As a result, the first starting lever 73 pushes the connecting piece 75 toward the downstream side in the feeding direction of the sheet material, and further the connecting piece 75 pushes the slide member urging spring 76. Then, the slide member urging spring 76 causes the slide member 72 to slide toward the downstream side in the feeding direction of the sheet material by the urging force thereof. The slide member 72 slides to the downstream side in the feeding direction of the sheet material so as to displace the rear-end displacement member 61 the lower end portion 61*b* of which is engaged with the engaging portion 72*a* toward the downstream side in the feeding direction of the sheet material (see FIG. 7).

When the cassette 42 is pulled out of the housing unit 41, the contact of the first starting lever 73 with the inner wall of the housing unit 41 is released. As shown in FIGS. 5 and 6, the first starting lever 73 is pressed by the urging force of the first starting lever urging spring 74 so that a part of the first starting lever 73 protrudes outward from the outer wall surface 42*a* on the upstream side of the cassette 42 in the feeding direction of the sheet material. As a result, the first starting lever 73 pulls the connecting piece 75 toward the upstream side in the feeding direction of the sheet material, and the connecting piece 75 further causes the slide member 72 to slide toward the upstream side in the feeding direction of the sheet material. The slide member 72 slides to the upstream side in the feeding direction of the sheet material so as to displace the rear-end displacement member 61 the lower end portion 61*b* of which is engaged with the engaging portion 72*a* toward the upstream side in the feeding direction of the sheet material (see FIG. 5).

Another configuration may be used if the structure is such that when the cassette 42 is stored in the housing unit 41, the slide member 72 slides to the downstream side in the feeding direction of the sheet material so as to displace the rear-end displacement member 61 toward the downstream side in the feeding direction of the sheet material. That is, for example, the configuration may be employed in which the first starting lever 73, the connecting piece 75, and the slide member urging spring 76 have been eliminated, and a part of the slide member 72 protrudes outward from the outer wall surface 42*a* on the upstream side of the cassette 42 in the feeding direction of the sheet material when the cassette 42 has been pulled out of the housing unit 41. In this case, the first starting lever urging spring 74 directly urges the slide member 72 toward the upstream side in the feeding direction of the sheet material.

In this manner, the rear-end displacement member displacing device 70 displaces the rear-end displacement member 61 toward the downstream side in the feeding direction of the sheet material while the cassette 42 is stored in the housing unit 41, and causes the rear-end displacement member 61 to change its position to the feeding position.

Accordingly, the downstream end (leading edge) of the sheet material in the feeding direction can be automatically moved to a predetermined feeding position.

Since the rear-end displacement member displacing device 70 changes the position of the rear-end displacement member 61 by a mechanism that does not obtain power from an electric driving source, cost increase is suppressed and low power consumption can be achieved.

In addition, while the cassette 42 is pulled out of the housing unit 41, the rear-end displacement member displacing device 70 displaces the rear-end displacement member 61 toward the upstream side in the feeding direction of the sheet material, and changes the position of the rear-end displacement member 61 to the retracted position. Thereby, when the sheet material is supplied to the inside of the cassette 42, the rear-end displacement member 61 does not become an obstacle, and workability of replenishment can be improved.

Further, the rear-end displacement member displacing device 70 includes the first starting lever 73 which comes in contact with the housing unit 41 while the cassette 42 is stored in the housing unit 41, and thus when the cassette 42 is stored in the housing unit 41, the position of the rear-end displacement member 61 can be easily changed to the feeding position.

Next, a detailed structure of the pushing-up plate displacing device 80 and its surroundings will be described with reference to FIGS. 9 to 16. FIGS. 9, 10, 11, and 12 are a partial plan view, partial front view, bottom view, and perspective view of the cassette 42 respectively when the cassette 42 has been pulled out. FIGS. 13, 14, 15 and 16 are a partial plan view, partial front view, bottom view and perspective view of the cassette 42 respectively when the cassette 42 is stored. In FIGS. 9, 10, 13, and 14, the drawings of some constituent elements such as the open top flat box-shaped cassette 42 itself are omitted.

As shown in FIGS. 9 to 12, the cassette 42 is provided with the pushing-up plate displacing device 80 for changing the position of the pushing-up plate 43. The pushing-up plate displacing device 80 includes a second starting lever 81, direct-acting link 82, turning link 83, pushing-up spring 84, turning lever 85, rotary shaft 86 and pushing-up lever 87.

The second starting lever 81 is provided in an outer bottom portion of the cassette 42 and below the first starting lever 73. The second starting lever 81 has a plate shape extending along the bottom surface of the cassette 42 and extends in the width direction of the sheet material. The second starting lever 81 is supported on the outer bottom surface of the cassette 42 via a substantially vertically extending support shaft portion 81*a* provided at one end of the second starting lever 81. The support shaft portion 81*a* is provided on the backside relative to the center portion of the cassette 42 in the width direction of the sheet material, and the second starting lever 81 extends toward the front side from the support shaft portion 81*a*. The second starting lever 81 is rotatable around the axis of the support shaft portion 81*a*.

The direct-acting link 82 is provided on the front side relative to the central portion in the width direction of the sheet material in the bottom portion of the cassette 42. The direct-acting link 82 has an elongated shape extending along the bottom surface of the cassette 42 and extends in parallel to the feeding direction of the sheet material. The direct-acting link 82 is guided by a guide member (not shown) and can be moved in parallel to the feeding direction of the sheet material. The end portion on the front side of the second starting lever 81 is connected to an upstream end of the direct-acting link 82 in the feeding direction of the sheet material, and a lower end of the turning link 83 is connected to a downstream end of the direct-acting link 82 in the feeding direction of the sheet material. The direct-acting link 82 can be slightly displaced to the front side and the back side according to the rotation of the second starting lever 81.

The turning link 83 is provided in a region corresponding to the downstream end of the direct-acting link 82 in the feeding direction of the sheet material on the front side of the substantially upstream portion of the pushing-up plate 43 in the feeding direction of the sheet material. The turning link 83 has an elongated shape extending substantially in the vertical direction. The turning link 83 is supported on the cassette 42 via a support shaft portion 83*a* provided at the substantially center portion in the vertical direction and extending in the substantially horizontal direction in the width direction of the sheet material. The turning link 83 can rotate clockwise or counterclockwise as viewed from the front around the axis of the support shaft portion 83*a* (see FIG. 10). The downstream end of the direct-acting link 82 in the feeding direction of the sheet material is connected to the lower end of the turning link 83 and the upstream end of the pushing-up spring 84 in the feeding direction of the sheet material is connected to the upper end of the turning link 83.

The pushing-up spring 84 is formed of an extension coil spring for example and extends from the region corresponding to the upper end of the turning link 83 toward the downstream side in the feeding direction of the sheet material. An upper end of the turning link 83 is connected to an upstream end of the pushing-up spring 84 in the feeding direction of the sheet material, and an upper end of the turning lever 85 is connected to a downstream end of the pushing-up spring 84 in the feeding direction of the sheet material. The pushing-up spring 84 exerts an elastic force (urging force) by pulling between the upper end of the turning link 83 and the upper end of the turning lever 85.

The pushing-up spring 84 urges the second starting lever 81 in the rotating direction around the axis of the support shaft portion 81*a* via the turning link 83 and the direct-acting link 82. Accordingly, when the cassette 42 has been pulled out of the housing unit 41, a part of the second starting lever 81 protrudes outward from the outer wall surface 42*a* on the upstream side of the cassette 42 in the feeding direction of the sheet material (see FIGS. 11 and 12).

The turning lever 85 is provided in a region corresponding to the downstream end of the pushing-up spring 84 in the feeding direction of the sheet material on the front side of a substantially center portion of the pushing-up plate 43 in the feeding direction of the sheet material. The turning lever 85 has an elongated shape extending substantially in the vertical direction. The lower end of the turning lever 85 is supported by the rotary shaft 86 extending in the width direction of the sheet material and substantially in the horizontal direction. The turning lever 85 is rotatable around the axis of the rotary shaft 86 clockwise or counterclockwise as viewed from the front (see FIG. 10). The downstream end of the pushing-up spring 84 in the feeding direction of the sheet material is connected to the upper end which is the free end of the turning lever 85.

Figure 9:
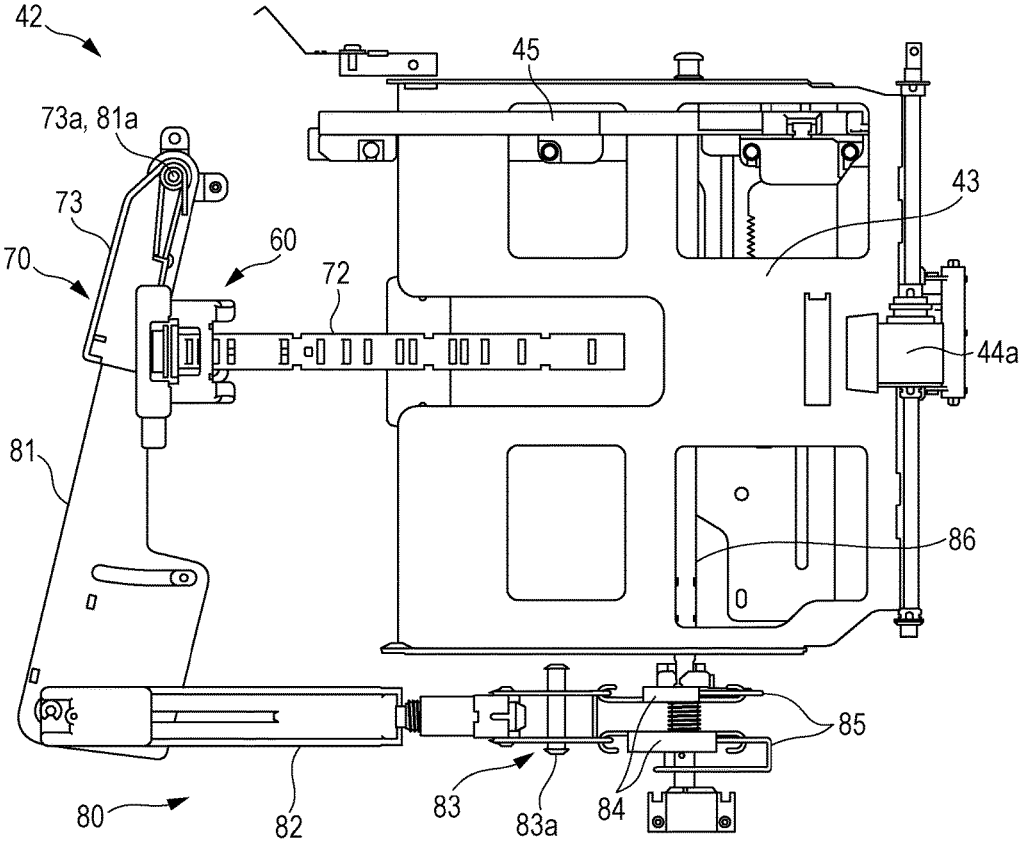
FIG. 9 is a partial plan view of the cassette of the sheet material feeding device according to the first embodiment of the present invention when the cassette has been pulled out.
Figure 10:
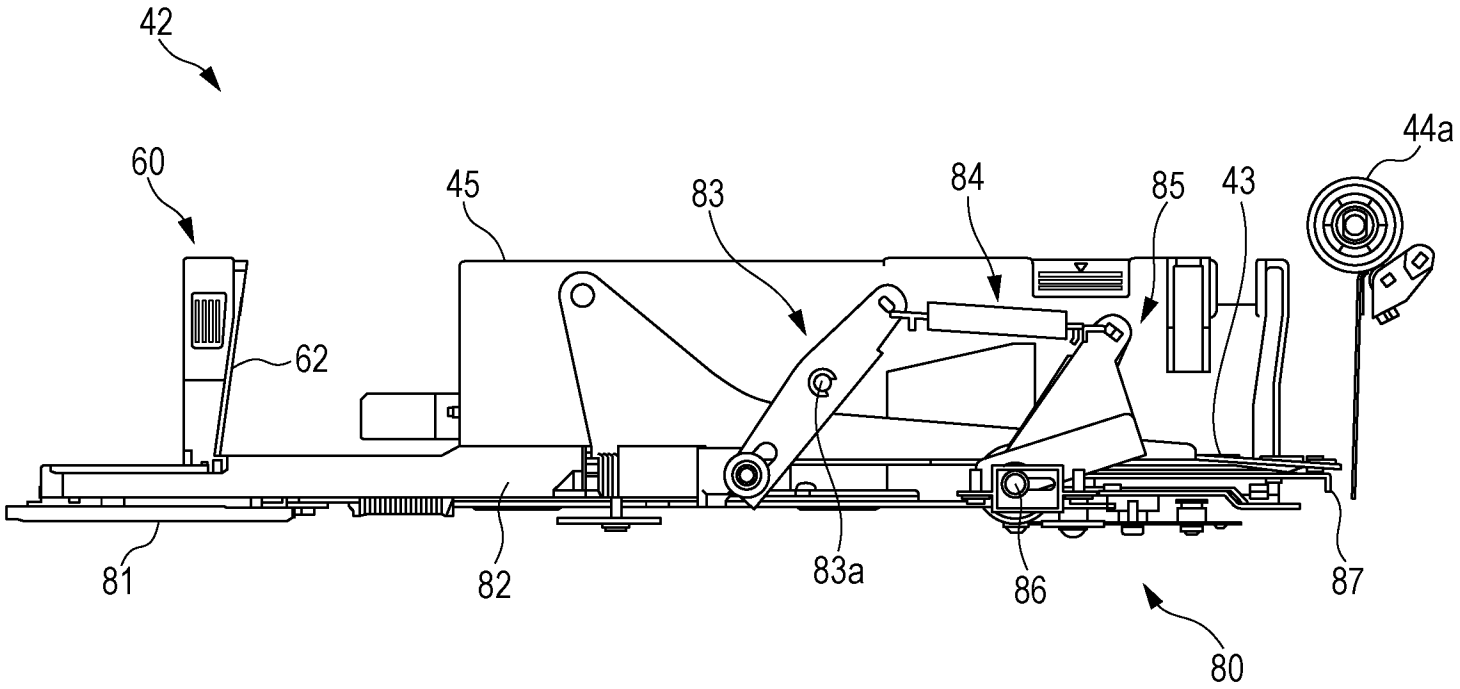
FIG. 10 is a partial front view of the cassette of the sheet material feeding device according to the first embodiment of the present invention when the cassette has been pulled out.

As shown in FIGS. 9 and 10, the rotary shaft 86 is disposed in a position below the substantially center portion of the pushing-up plate 43 in the feeding direction of the sheet material and in the vicinity of the inner bottom surface of the cassette 42. The rotary shaft 86 extends to be relatively long in the width direction of the sheet material from the front side to the back side of the pushing-up plate 43, and both ends thereof are rotatably supported by the cassette 42.

The pushing-up lever 87 is provided in a position below the downstream side portion of the pushing-up plate 43 in the feeding direction of the sheet material and at the center portion of the pushing-up plate 43 in the width direction of the sheet material. The pushing-up lever 87 has a plate shape an upper surface of which is substantially opposed to the lower surface of the pushing-up plate 43, and a portion of one side thereof extending in the width direction of the sheet material at the upstream end thereof in the feeding direction of the sheet material is attached to the rotary shaft 86. The pushing-up lever 87 extends outward in the radial direction of the rotary shaft 86 and toward the downstream side in the feeding direction of the sheet material. The downstream end of the pushing-up lever 87 in the feeding direction of the sheet material is in contact with the lower surface of the pushing-up plate 43. The pushing-up lever 87 rotates around the axis of the rotary shaft 86 in accordance with the rotation of the rotary shaft 86.

When the cassette 42 is stored in the housing unit 41, the second starting lever 81 comes into contact with the inner wall of the housing unit 41, and as shown in FIGS. 13 to 16, the second starting lever 81 entirely retracts inward from the outer wall surface 42*a* on the upstream side of the cassette 42 in the feeding direction of the sheet material. As a result, the second starting lever 81 pushes the direct-acting link 82 toward the downstream side in the feeding direction of the sheet material, and furthermore, the direct-acting link 82 rotates the turning link 83 counterclockwise as seen from the front. Then, the pushing-up spring 84 rotates the turning lever 85 counterclockwise as seen from the front by the urging force. While the turning lever 85 rotates, the rotary shaft 86 also rotates counterclockwise as viewed from the front, so that the pushing-up lever 87 pushes up the downstream side portion of the pushing-up plate 43 in the feeding direction of the sheet material from below the pushing-up plate 43. Thereby, the uppermost layer of the sheet materials stacked on the upper surface of the pushing-up plate 43 reaches a predetermined feeding position where the uppermost layer contacts the circumferential surface of the feeding roller 44*a*.

When the cassette 42 is pulled out from the housing unit 41, the contact of the second starting lever 81 with the inner wall of the housing unit 41 is released, and as shown in FIGS. 9 to 12, a part of the second starting lever 81 protrudes outward from the outer wall surface 42*a* on the upstream side of the cassette 42 in the feeding direction of the sheet material by urging force of the pushing-up spring 84. As a result, the second starting lever 81 pulls the direct-acting link 82 toward the upstream side in the feeding direction of the sheet material, and the direct-acting link 82 further rotates the turning link 83 clockwise as viewed from the front. The turning lever 85 also rotates clockwise when viewed from the front through the pushing-up spring 84. When the pushing-up lever 87 falls down on the inner bottom surface of the cassette 42, the pushing-up plate 43 also falls down on the inner bottom surface of the cassette 42.

As described above, the pushing-up plate displacing device 80 pushes up the pushing-up plate 43 while the cassette 42 is stored in the housing unit 41, and changes the position of the pushing-up plate 43 to the feeding position. Accordingly, the uppermost layer of the sheet materials can be automatically moved to a predetermined feeding position.

Since the pushing-up plate displacing device 80 changes the position of the pushing-up plate 43 by a mechanism that does not obtain power from the electric drive source, cost increase is suppressed and low power consumption can be achieved.

In addition, the pushing-up plate displacing device 80 lays down the pushing-up plate 43 to the inner bottom surface of the cassette 42 while the cassette 42 is pulled out of the housing unit 41, thereby changing the position of the pushing-up plate 43 to the retracted position. Thereby, when the sheet material is supplied to the inside of the cassette 42, the pushing-up plate 43 does not become an obstacle, and workability of replenishment can be improved.

Further, since the pushing-up plate displacing device 80 includes the second starting lever 81 which comes in contact with the housing unit 41 while the cassette 42 is stored in the housing unit 41, the position of the pushing-up plate 43 can be easily changed to the feeding position when the cassette 42 is stored in the housing unit 41.

Figure 11:
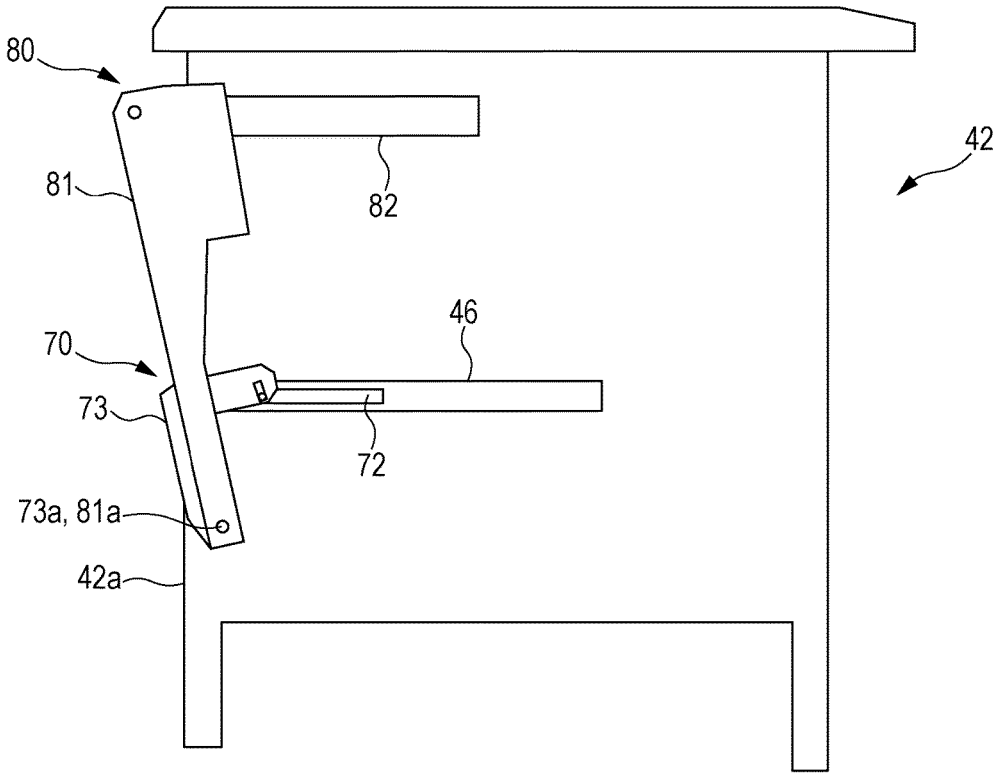
FIG. 11 is a bottom view of the cassette of the sheet material feeding device according to the first embodiment of the present invention when the cassette has been pulled out.
Figure 12:
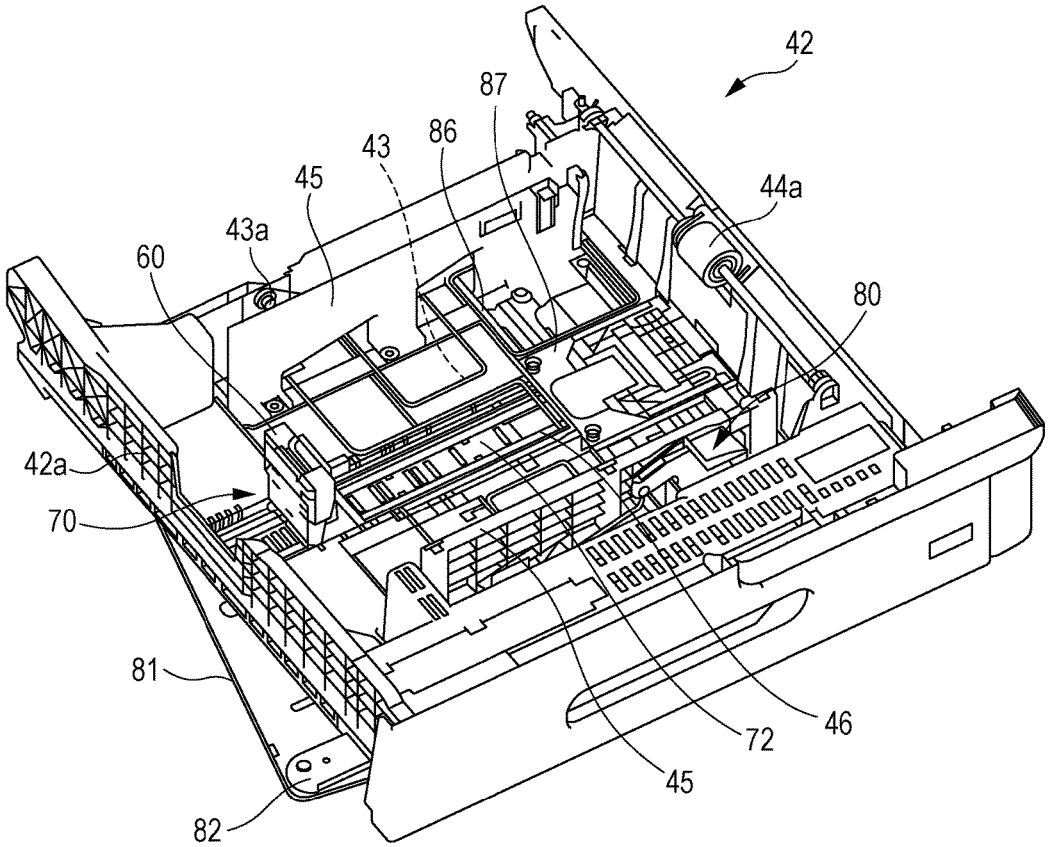
FIG. 12 is a perspective view of the cassette of the sheet material feeding device according to the first embodiment of the present invention when the cassette has been pulled out.
Figure 13:
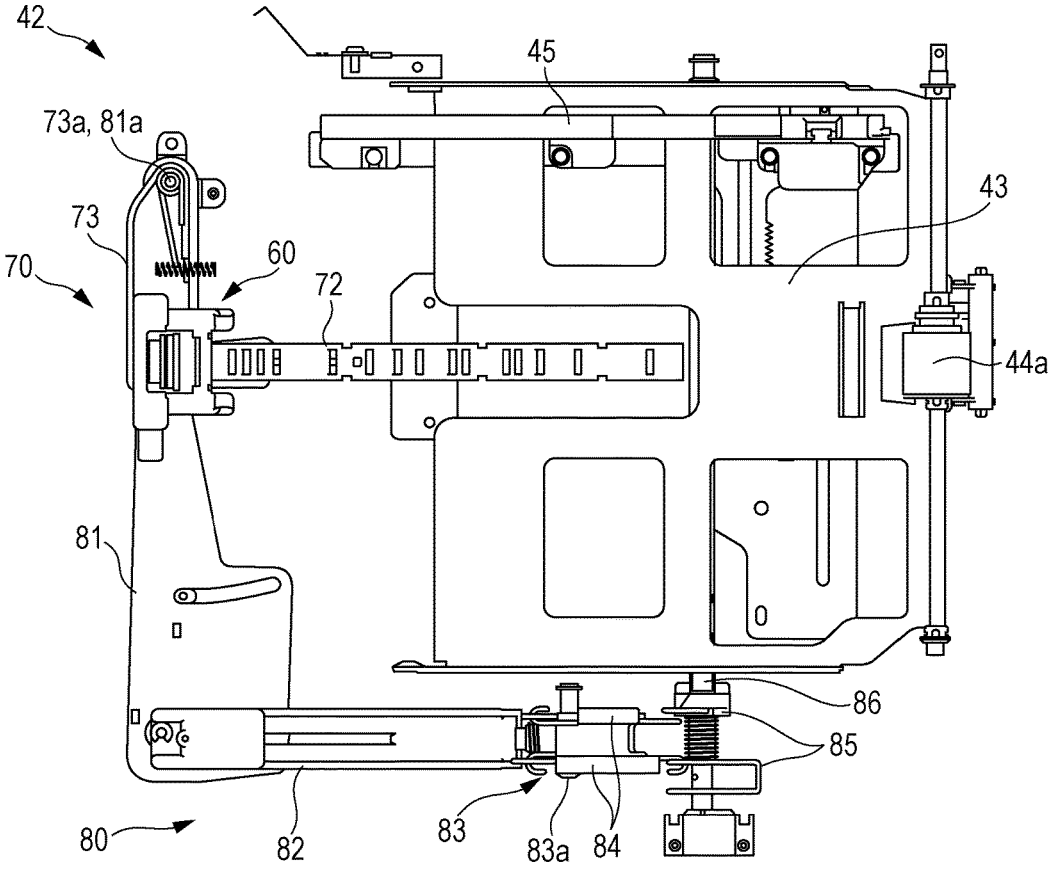
FIG. 13 is a partial plan view of the cassette of the sheet material feeding device according to the first embodiment of the present invention when the cassette is stored.
Figure 14:
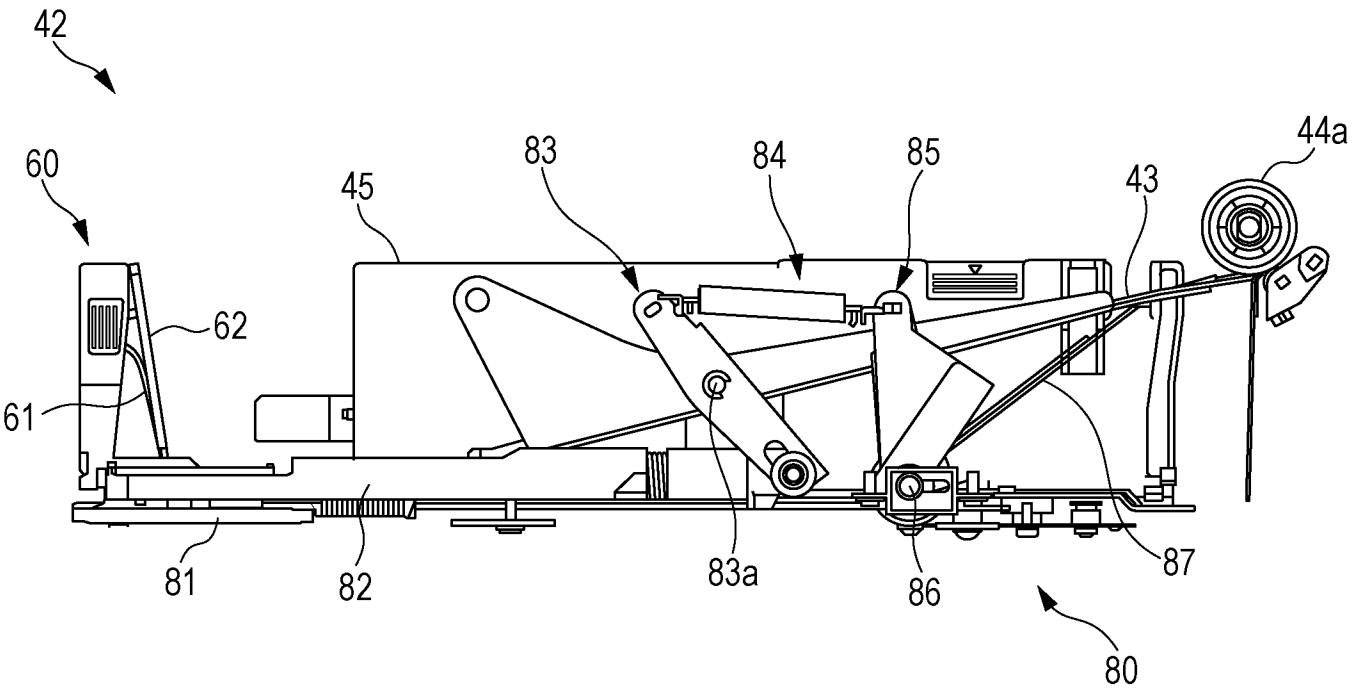
FIG. 14 is a partial front view of the cassette of the sheet material feeding device according to the first embodiment of the present invention when the cassette is stored.
Figure 15:
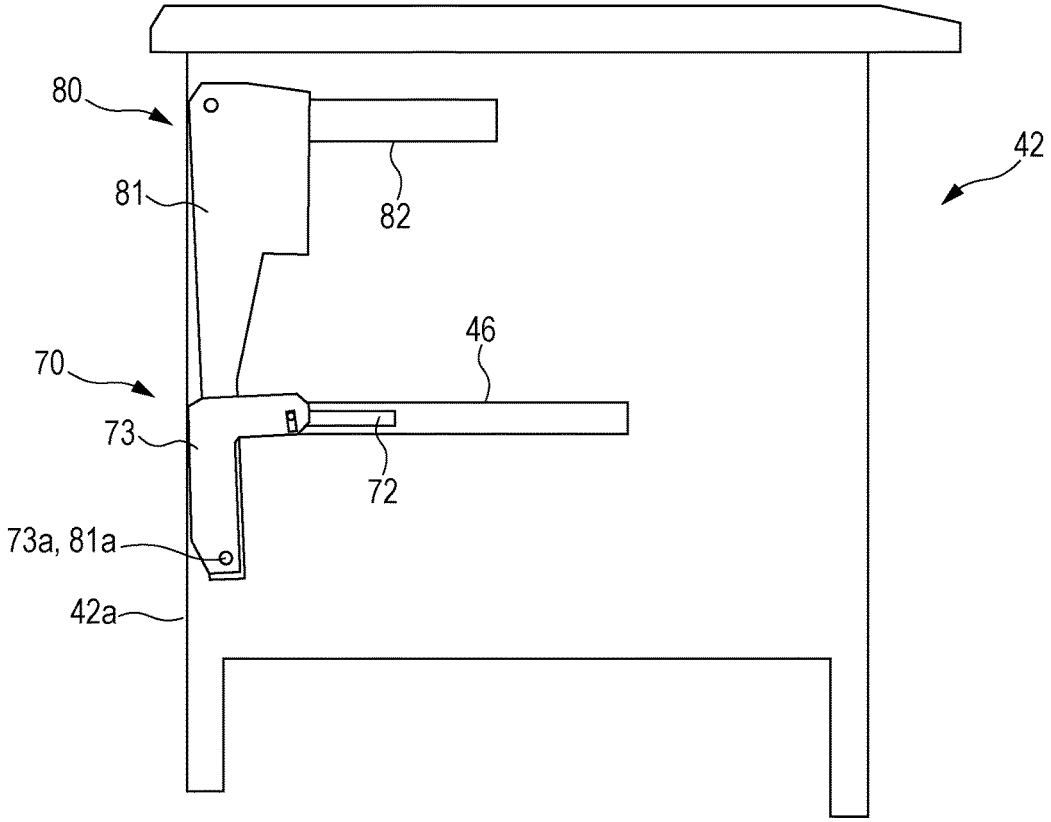
FIG. 15 is a bottom view of the cassette of the sheet material feeding device according to the first embodiment of the present invention when the cassette is stored.
Figure 16:
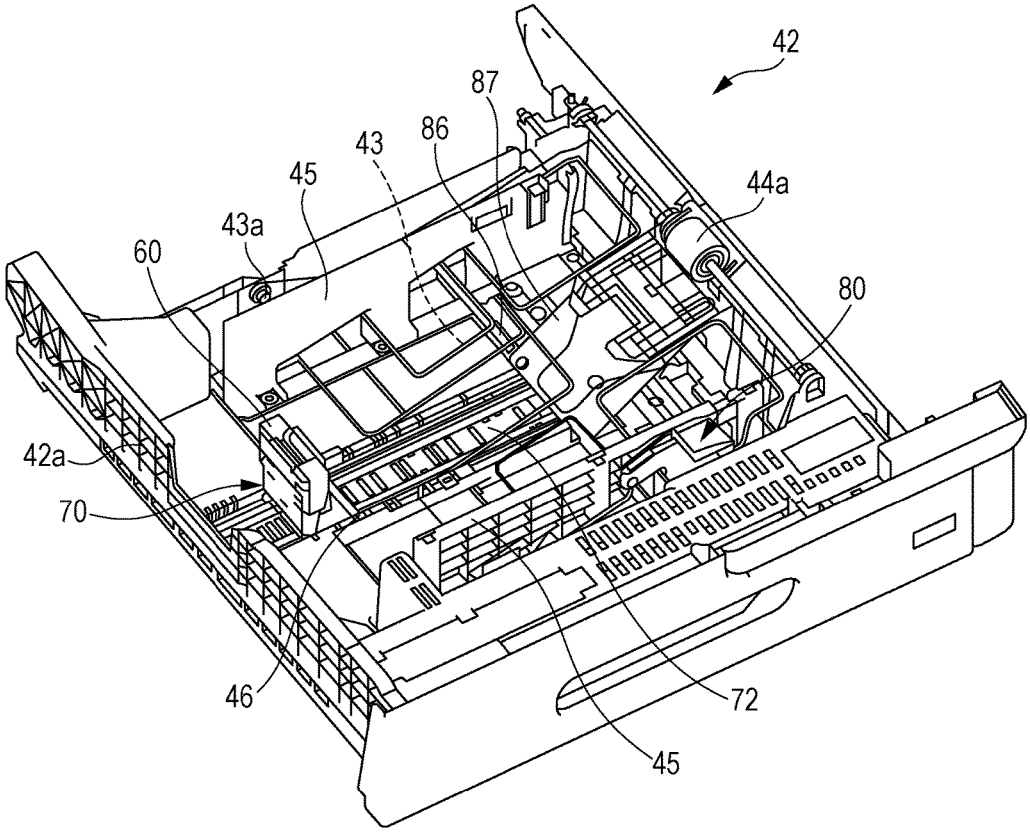
FIG. 16 is a perspective view of the cassette of the sheet material feeding device according to the first embodiment of the present invention when the cassette is stored.

The axis of the support shaft portion 81*a* of the second starting lever 81 coincides with the axis of the support shaft portion 73*a* of the first starting lever 73. As shown in FIGS. 9 and 11, the support shaft portion 81*a* and the support shaft portion 73*a* are provided on the back side of the center portion of the cassette 42 in the width direction of the sheet material, and the second starting lever 81 and the first starting lever 73 extend from the support shaft portion toward the front side. Regarding the length in the width direction of the sheet material, the second starting lever 81 is longer than the first starting lever 73. Thus, when the cassette 42 is stored in the housing unit 41, the first starting lever 73 completes its rotational displacement before the second starting lever 81 completes its own displacement. That is, the position change of the rear-end displacement member 61 to the feeding position by the rear-end displacement member displacing device 70 is completed before the change of the position of the pushing-up plate 43 to the feeding position by the pushing-up plate displacing device 80 is completed.

According to this configuration, the timing of changing the position of the rear-end displacement member 61 to the sheet material feeding position due to the insertion of the cassette 42 into the housing unit 41 is earlier than the timing of changing the position of the pushing-up plate 43 to the sheet material feeding position. The rear-end displacement member 61 is displaced toward the downstream side in the feeding direction of the sheet material before the uppermost layer of the sheet materials stacked on the upper surface of the pushing-up plate 43 comes in contact with the circumferential surface of the feeding roller 44*a*. As a result, regardless of the number of the sheet materials inside the cassette 42, the sheet materials can be arranged in a proper position with respect to the feeding direction. Therefore, a stable feeding can be achieved corresponding to the change of the posture of the sheet materials due to reduction caused by feeding the sheet materials inside the cassette 42.

Since the first starting lever 73 comes in contact with the housing unit 41 earlier than the second starting lever 81, a configuration can be easily obtained in which the position change of the rear-end displacement member 61 to the feeding position is completed before the position change of the pushing-up plate 43 to the feeding position is completed.

Second Embodiment

Figure 17:
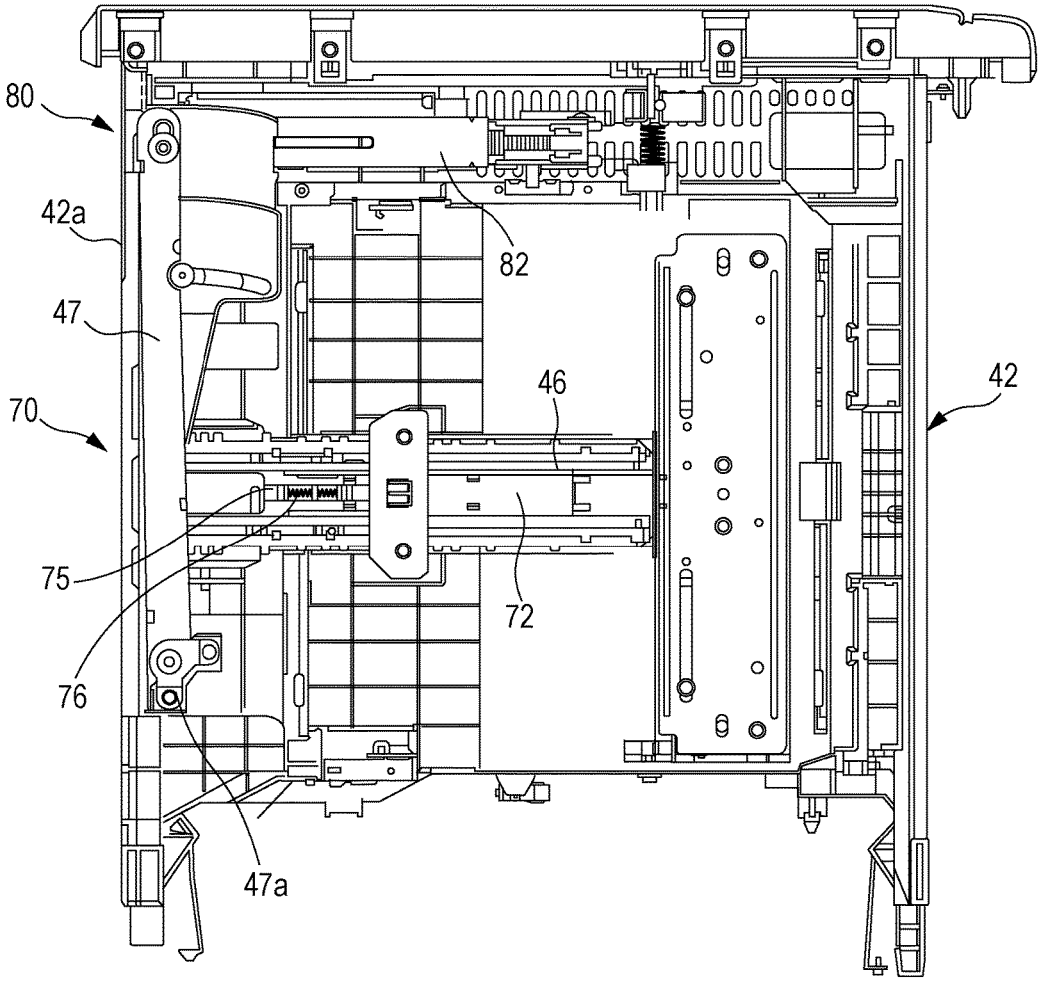
FIG. 17 is a bottom view of a cassette of a sheet material feeding device according to a second embodiment of the present invention when the cassette is stored.

Next, a sheet material feeding device according to a second embodiment of the present invention will be described with reference to FIG. 17. FIG. 17 is a bottom view of the cassette of the sheet material feeding device when the cassette is stored. Since the basic configuration of the present embodiment is the same as that of the first embodiment described above, the same names and the same reference numerals are given to the constituent elements common to the first embodiment, and detailed description may be omitted.

The sheet material feeding device 40 according to the second embodiment includes a single starting lever 47 as shown in FIG. 17. The starting lever 47 is made by forming the first starting lever 73 and the second starting lever 81 described in the first embodiment as a single member.

The starting lever 47 is provided on the outer bottom portion of the cassette 42. The starting lever 47 has a plate shape extending along the bottom surface of the cassette 42. The starting lever 47 is supported on the outer bottom surface of the cassette 42 via a support shaft portion 47*a* which is provided at one end of the lever and extends in a substantially vertical direction. The support shaft portion 47*a* is provided on the back side (the lower side in FIG. 17) of the center portion of the cassette 42 in the width direction of the sheet material, and the starting lever 47 extends from the support shaft portion 47*a* toward the front side (the upper side in FIG. 17). The starting lever 47 is rotatable around the axis of the support shaft portion 47*a*.

The starting lever 47 is connected to the connecting piece 75 of the rear-end displacement member displacing device 70 at the center portion of the cassette 42 in the width direction of the sheet material. Further, the starting lever 47 is connected to the direct-acting link 82 of the pushing-up plate displacing device 80 on the front side of the center portion of the cassette 42 in the width direction of the sheet material.

As described above, in the sheet material feeding device 40 according to the second embodiment, even when the single starting lever 47 is used, the position change of the rear-end displacement member 61 to the feeding position by the rear-end displacement member displacing device 70 is completed before the position change of the pushing-up plate 43 to the feeding position by the pushing-up plate displacing device 80 is completed. Therefore, the number of parts and the number of assembling steps of the sheet material feeding device 40 can be reduced, and it is possible to save resources and reduce costs.

Third Embodiment

Figure 18:
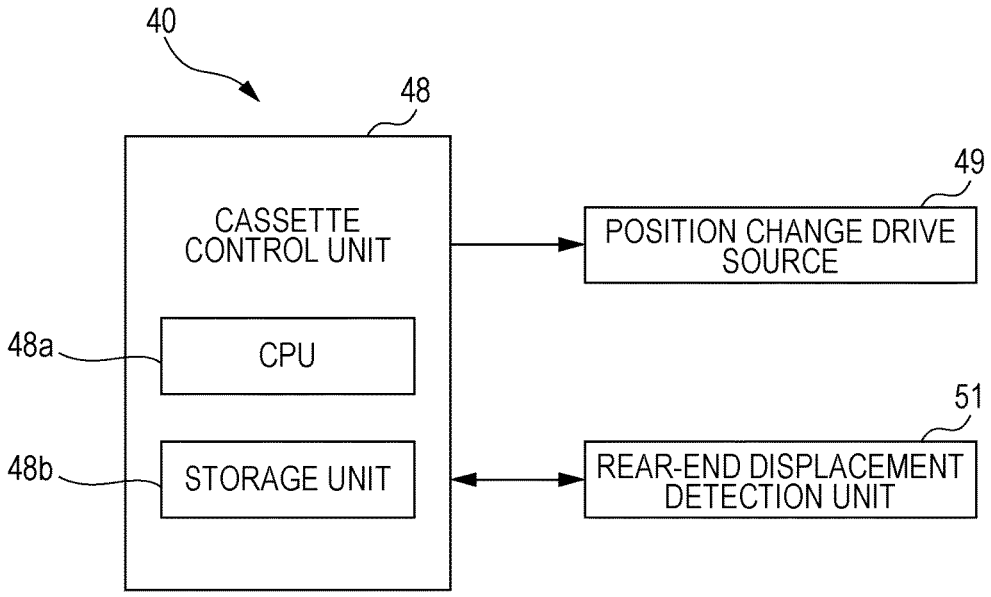
FIG. 18 is a block diagram showing a configuration of a cassette of a sheet material feeding device according to a third embodiment of the present invention.
Figure 19:
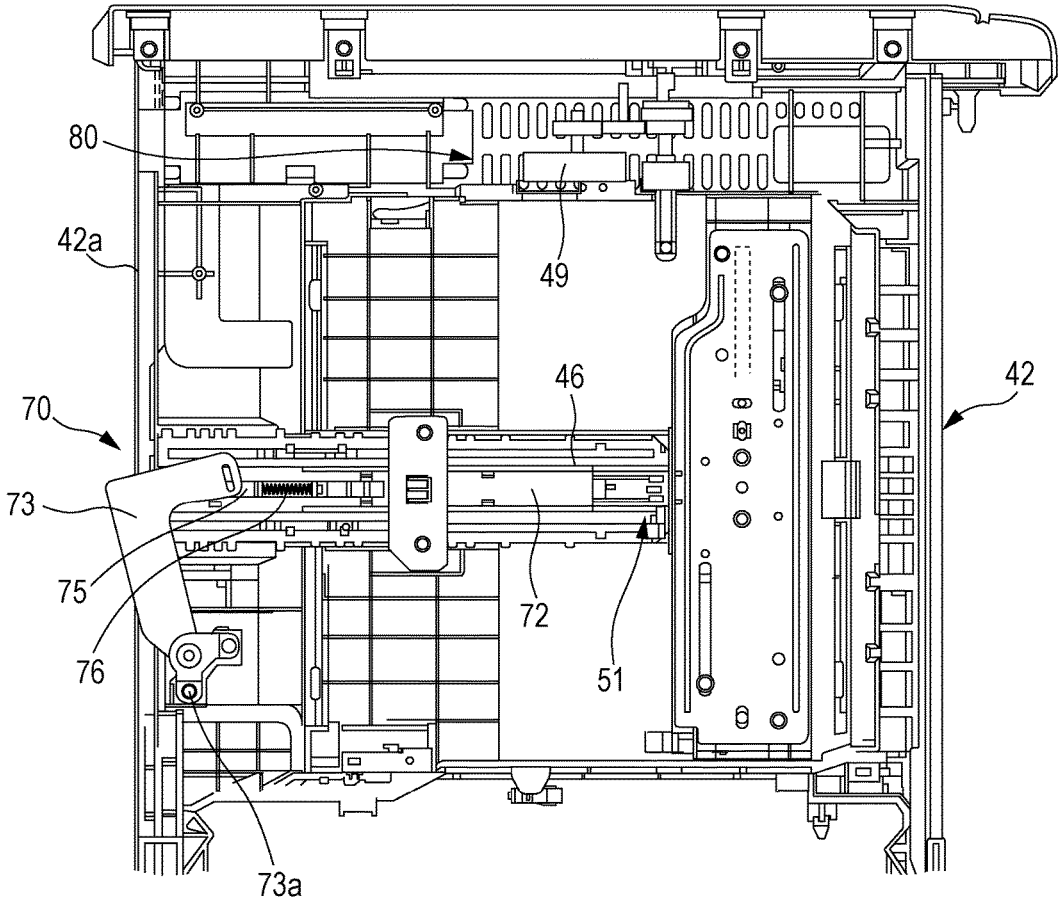
FIG. 19 is a bottom view of the cassette of the sheet material feeding device according to the third embodiment of the present invention when the cassette has been pulled out.
Figure 20:
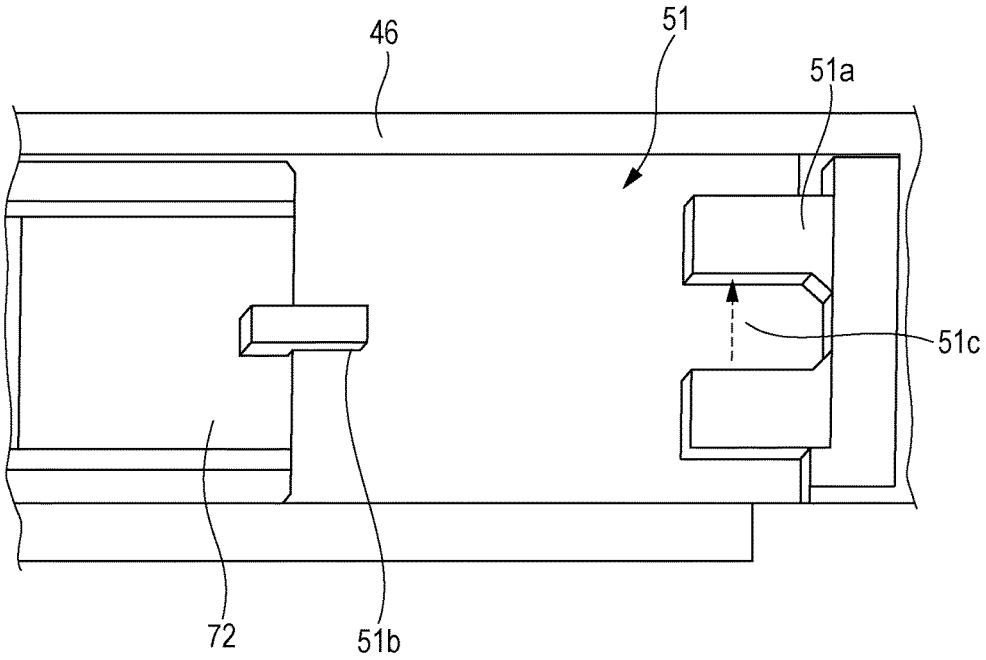
FIG. 20 is a partially enlarged bottom view of the cassette of the sheet material feeding device according to the third embodiment of the present invention when the cassette has been pulled out.
Figure 21:
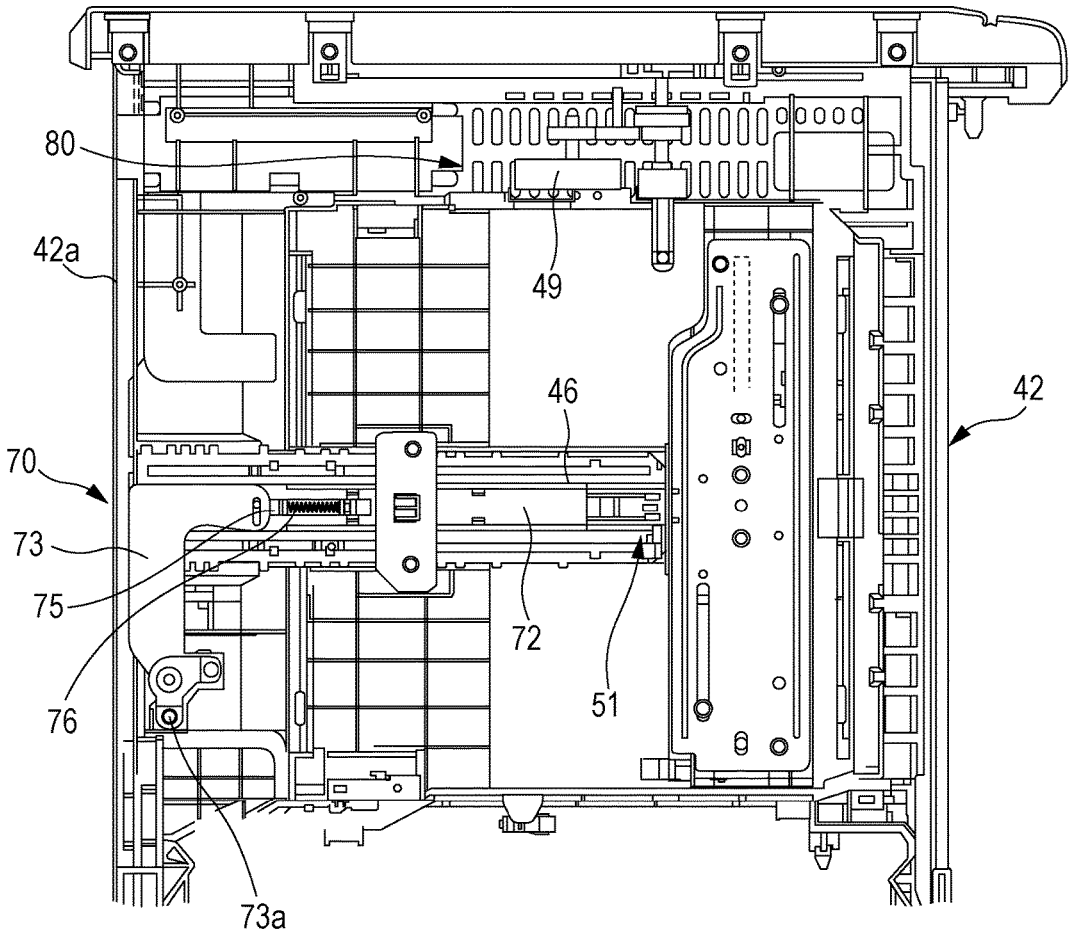
FIG. 21 is a bottom view of the cassette of the sheet material feeding device according to the third embodiment of the present invention when the cassette is stored.
Figure 22:
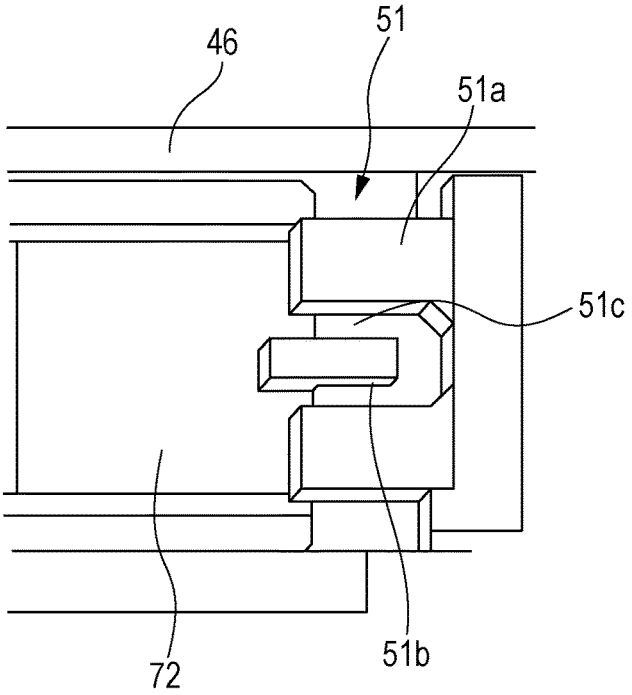
FIG. 22 is a partially enlarged bottom view of the cassette of the sheet material feeding device according to the third embodiment of the present invention when the cassette is stored.

Next, a sheet material feeding device according to a third embodiment of the present invention will be described with reference to FIGS. 18 to 22. FIG. 18 is a block diagram showing a configuration of a cassette of the sheet material feeding device. FIGS. 19 and 20 are a bottom view and a partially enlarged bottom view of the cassette when the cassette has been pulled out. FIGS. 21 and 22 are a bottom view and a partially enlarged bottom view of the cassette when the cassette is stored. Since the basic configuration of the present embodiment is the same as that of the first embodiment described above, the same names and the same reference numerals are given to the constituent elements common to the first embodiment, and detailed description may be omitted.

As shown in FIGS. 18 to 20, the sheet material feeding device 40 of the third embodiment includes a cassette control unit 48, a position change drive source 49, and a rear-end displacement detection unit 51.

The cassette control unit 48 includes ICs such as a CPU 48*a* serving as a processing circuit and a storage unit 48*b*, and other electronic components, and controls the operation of the pushing-up plate displacing device 80. The cassette control unit 48 receives the information on the position change of the rear-end displacement member 61 from the rear-end displacement detection unit 51 and transmits a control signal related to the position change of the pushing-up plate 43 to the position change drive source 49.

The position change drive source 49 is constituted by a motor for example and is provided in the vicinity of the pushing-up plate displacing device 80. The position change drive source 49 is connected to the rotary shaft 86 via a gear, a belt, or the like, and rotates the rotary shaft 86 around its axis. The position change drive source 49 rotates the rotary shaft 86 based on the control signal received from the cassette control unit 48 and changes the position of the pushing-up plate 43 via the pushing-up lever 87.

The rear-end displacement detection unit 51 includes a sensor unit 51*a* and a light shielding piece 51*b* shown in FIG. 20. The sensor unit 51*a* is disposed at the downstream end of the guide rail 46 in the feeding direction of the sheet material. The sensor unit 51*a* is formed of a transmission type optical sensor having a light emitting unit and a light receiving unit and is disposed such that the open portion of an optical path 51*c* faces the upstream side in the feeding direction of the sheet material. The light shielding piece 51*b* is disposed at the downstream end of the slide member 72 in the feeding direction of the sheet material and further protrudes toward the downstream side. The light shielding piece 51*b* is disposed at a position so as to enter and retreat from the optical path 51*c* of the sensor unit 51*a* when the slide member 72 slides in parallel to the feeding direction of the sheet material.

The rear-end displacement detection unit 51 detects the displacement of the slide member 72 using the sensor unit 51*a* and the light shielding piece 51*b*. The rear-end displacement detection unit 51 transmits a detection signal related to the displacement of the slide member 72 to the cassette control unit 48.

As shown in FIG. 21, the slide member 72 has an enough length so that the downstream end of the slide member 72 in the feeding direction of the sheet material reaches the downstream end of the guide rail 46 in the feeding direction of the sheet material when the first starting lever 73 comes in contact with the inner wall of the housing unit 41 and the position change of the rear-end displacement member 61 to the feeding position by the rear-end displacement member displacing device 70 is completed while the cassette 42 is stored in the housing unit 41. That is, when position change of the rear-end displacement member 61 to the feeding position by the rear-end displacement member displacing device 70 is completed, the light shielding piece 51*b* blocks the optical path 51*c* of the sensor unit 51*a* as shown in FIG. 22. As a result, the detection signal of the rear-end displacement detection unit 51 is transmitted to the cassette control unit 48, and the cassette control unit 48 transmits a control signal for changing the position of the pushing-up plate 43 to the feeding position to the position change drive source 49.

As described above, in the sheet material feeding device 40 of the third embodiment, after the position change of the rear-end displacement member 61 to the feeding position by the rear-end displacement member displacing device 70 is completed, the position change of the pushing-up plate 43 to the feeding position by the pushing-up plate displacing device 80 is started. This can improve the operation of arranging the sheet materials at a proper position with respect to the feeding direction regardless of the number of the sheet materials inside the cassette 42. Therefore, stable feeding can be effectively achieved corresponding to the change of the posture of the sheet materials caused as the number of the sheet materials inside the cassette 42 is reduced by feeding.

Since the sheet material feeding device 40 has the position change drive source 49 which is an electric drive source for changing the position of the pushing-up plate 43, the position of the pushing-up plate 43 can be easily changed to the feeding position by using the power of a motor for example. The position change drive source 49 is not limited to a motor and may be a solenoid or other electric drive sources.

Fourth Embodiment

Figure 23:
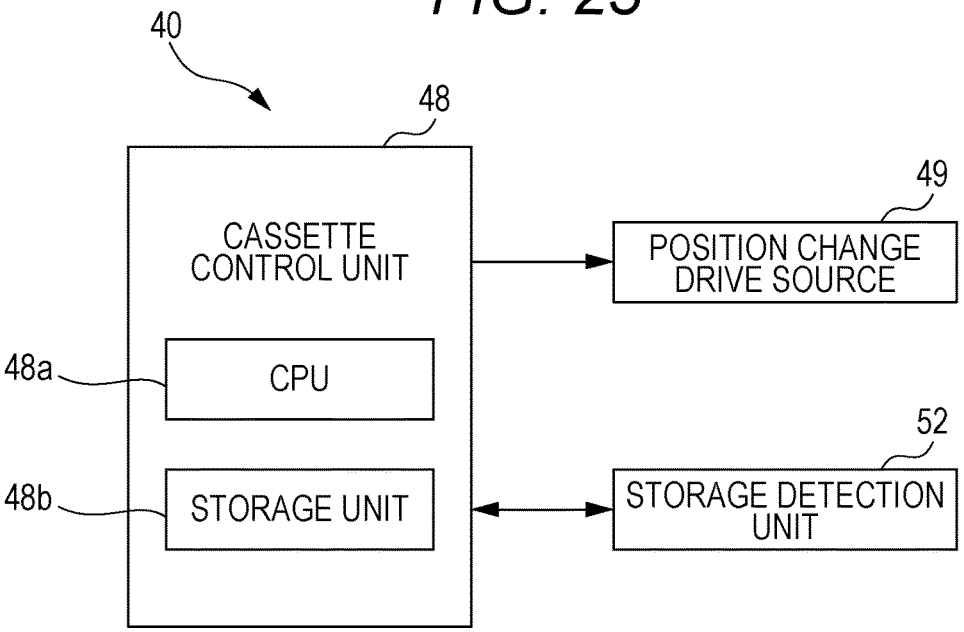
FIG. 23 is a block diagram showing a configuration of a cassette of a sheet material feeding device according to a fourth embodiment of the present invention.
Figure 24:
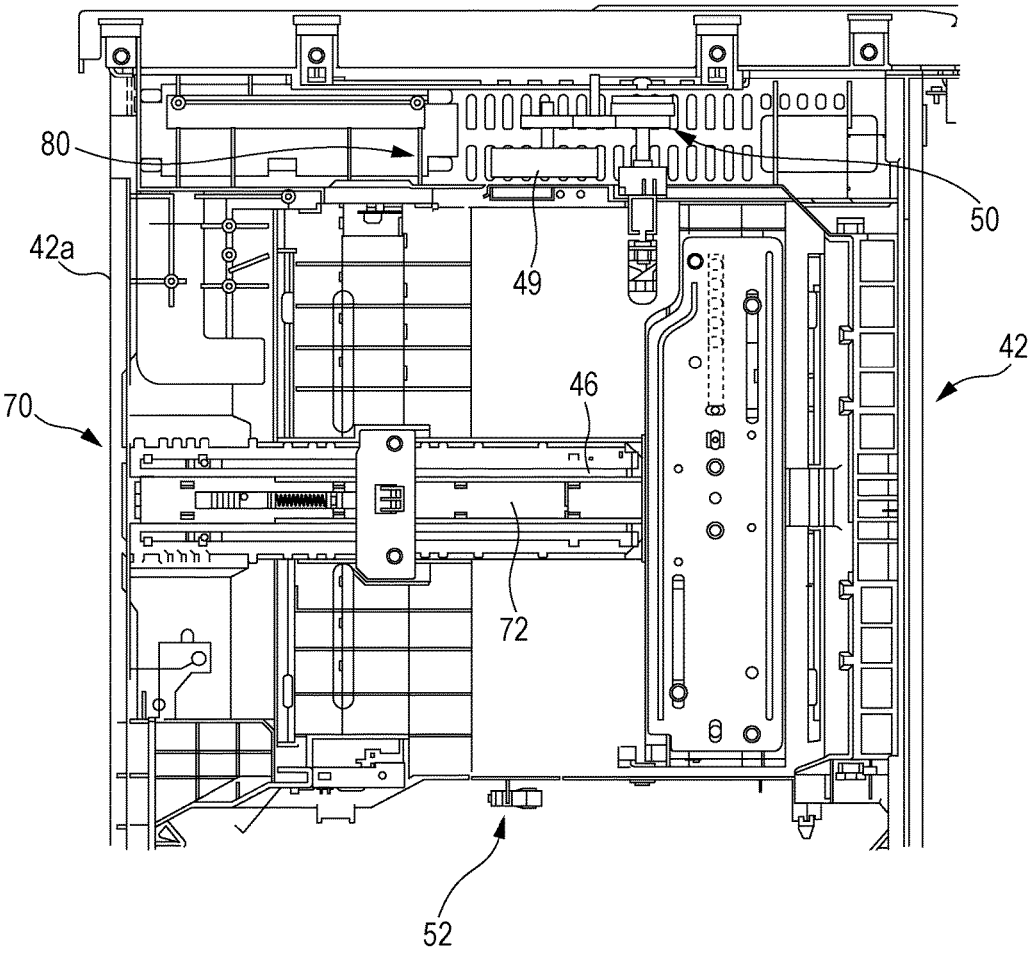
FIG. 24 is a bottom view of the cassette of the sheet material feeding device according to the fourth embodiment of the present invention when the cassette is stored.
Figure 25:
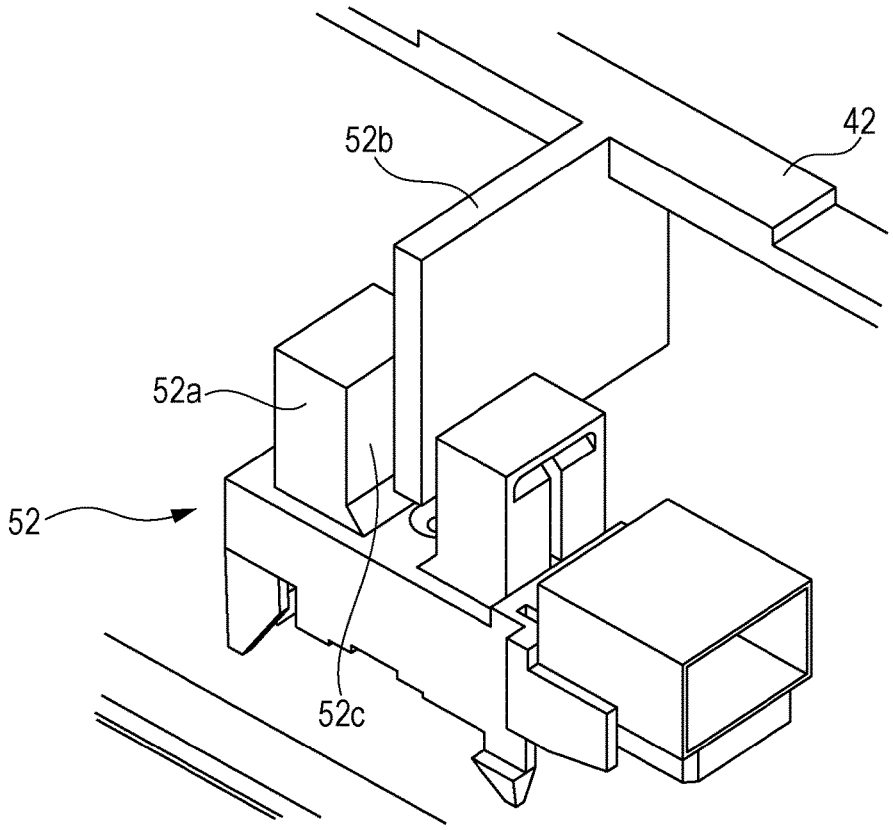
FIG. 25 is a partially enlarged perspective view of the cassette of the sheet material feeding device according to the fourth embodiment of the present invention when the cassette is stored.

Next, a sheet material feeding device according to a fourth embodiment of the present invention will be described with reference to FIGS. 23 to 25. FIG. 23 is a block diagram showing a configuration of a cassette of the sheet material feeding device. FIGS. 24 and 25 are a bottom view and a partially enlarged perspective view of the cassette when the cassette is stored. Since the basic configuration of the present embodiment is the same as that of the first and third embodiments described above, the same names and the same reference numerals are given to the constituent elements common to these embodiments, and detailed description may be omitted.

As shown in FIGS. 23 to 25, the sheet material feeding device 40 of the fourth embodiment includes the cassette control unit 48, the position change drive source 49, a clutch 50, and a storage detection unit 52.

The cassette control unit 48 includes ICs such as the CPU 48*a* serving as a processing circuit, and the storage unit 48*b*, and other electronic components, and controls operations of the rear-end displacement member displacing device 70 and the pushing-up plate displacing device 80. The cassette control unit 48 receives information on the storage and pullout of the cassette 42 with respect to the housing unit 41 from the storage detection unit 52 and transmits control signals to the position change drive source 49 and the clutch 50.

The position change drive source 49 is constituted by a motor for example and is provided in the vicinity of the pushing-up plate displacing device 80. The position change drive source 49 is connected to the slide member 72 via a gear, a belt, or the like, and slides the slide member 72 in parallel to the feeding direction of the sheet material. Further, the position change drive source 49 is connected to the rotary shaft 86 via a gear, a belt, or the like, and rotates the rotary shaft 86 around its axis. The position change drive source 49 slides the slide member 72 in the feeding direction of the sheet material based on the control signal received from the cassette control unit 48 and changes the position of the rear-end displacement member 61 via the slide member 72. Further, the position change drive source 49 rotates the rotary shaft 86 based on a control signal received from the cassette control unit 48, and changes the position of the pushing-up plate 43 via the pushing-up lever 87.

The clutch 50 is connected between the position change drive source 49 and the slide member 72 as well as the rotary shaft 86. Based on a control signal received from the cassette control unit 48, the clutch 50 switches the destination of the power generated by the position change drive source 49 between the rear-end displacement member displacing device 70 and the pushing-up plate displacing device 80.

The storage detection unit 52 includes a sensor unit 52*a* and a light shielding piece 52*b* shown in FIG. 25. The sensor unit 52*a* is disposed on a wall surface of the housing unit 41 that is close to and faces the back surface of the stored cassette 42. The sensor unit 52*a* is formed of a transmission type optical sensor having a light emitting unit and a light receiving unit, and the sensor unit 52*a* is disposed so that the open portion of an optical path 52*c* faces the cassette 42. The light shielding piece 52*b* is disposed on the back surface of the cassette 42 and further projects backward. The light shielding piece 52*b* is disposed at a position so as to enter and retreat from the optical path 52*c* of the sensor unit 52*a* when the cassette 42 is stored in and pulled out of the housing unit 41.

The storage detection unit 52 detects the storage and pullout of the cassette 42 with respect to the housing unit 41 using the sensor unit 52*a* and the light shielding piece 52*b*. The storage detection unit 52 transmits detection signals related to the storage and pullout of the cassette 42 with respect to the housing unit 41 to the cassette control unit 48.

When the cassette 42 is stored in the housing unit 41, the storage detection unit 52 detects the storage of the cassette 42 with respect to the housing unit 41. When having received the detection signal concerning the storage of the cassette 42 from the storage detection unit 52, the cassette control unit 48 switches the clutch 50 so that the power of the position change drive source 49 is transmitted to the slide member 72 of the rear-end displacement member displacing device 70 and drives the position change drive source 49. As a result, in the rear-end displacement member displacing device 70, the slide member 72 slides toward the downstream side in the feeding direction of the sheet material, and the rear-end displacement member 61 is displaced to the downstream side in the feeding direction of the sheet material.

The time required for changing the position of the rear-end displacement member 61 to the feeding position by the rear-end displacement member displacing device 70 is measured in advance and stored in the storage unit 48*b* or the like.

When the cassette control unit 48 confirms completion of the position change of the rear-end displacement member 61 to the feeding position by the rear-end displacement member displacing device 70, for example, by passage of time, the cassette control unit 48 switches the clutch 50 so that the power of the position change drive source 49 is transmitted to the rotary shaft 86 of the pushing-up plate displacing device 80 and drives the position change drive source 49. Thereby, as the rotary shaft 86 rotates in the pushing-up plate displacing device 80, the pushing-up lever 87 pushes up the pushing-up plate 43, and the uppermost layer of the sheet materials reaches a predetermined feeding position.

As described above, the sheet material feeding device 40 of the fourth embodiment has the position change drive source 49 which is an electric driving source for changing the position of the rear-end displacement member 61 and the pushing-up plate 43, and therefore, can change the position of the rear-end displacement member 61 and the pushing-up plate 43 to the feeding position easily by using power of a motor for example.

Although the embodiments of the present invention have been described above, the scope of the present invention is not limited thereto, and various modifications can be made without departing from the spirit of the invention. Further, a plurality of embodiments can be implemented in combination.

For example, in the above-described embodiment, the image forming apparatus 1 is a so-called image forming apparatus for tandem-type color printing in which images of a plurality of colors are sequentially superposed by using the intermediate transfer belt 11, but the image forming apparatus 1 is not limited to such a type and may be an image forming apparatus for color printing which is not a tandem type or an image forming apparatus for monochrome printing.

The present invention can be used in an image forming apparatus such as a copying machine.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A sheet material feeding device comprising:

a housing;

a cassette configured to accommodate a sheet material therein and capable of being pulled out of the housing and being stored in the housing;

a pushing-up plate which is disposed on an inner bottom surface of the cassette and configured to fluctuate in a vertical direction with the sheet material placed on an upper surface of the pushing-up plate and a position thereof is changed to a feeding position or a retracted position;

a rear-end regulating member provided inside the cassette for regulating a position of an upstream end of the sheet material in a feeding direction of the sheet material;

a rear-end displacement member which is supported by the rear-end regulating member and configured to fluctuate in the feeding direction of the sheet material and a position thereof is changed to a feeding position or a retracted position;

a pushing-up plate displacing device configured to change the position of the pushing-up plate to the feeding position when the cassette is stored in the housing; and a rear-end displacement member displacing device configured to complete a position change of the rear-end displacement member to the feeding position before a position change of the pushing-up plate to the feeding position by the pushing-up plate displacing device when the cassette is stored in the housing.

2. The sheet material feeding device according to claim 1, wherein after the position change of the rear-end displacement member to the feeding position by the rear-end displacement member displacing device is completed, the position change of the pushing-up plate to the feeding position by the pushing-up plate displacing device is started.

3. The sheet material feeding device according to claim 1, further comprising an electric drive source configured to change the position of the pushing-up plate.

4. The sheet material feeding device according to claim 1, further comprising an electric drive source configured to change the position of the rear-end displacement member.

5. The sheet material feeding device according to claim 1, wherein the pushing-up plate displacing device changes the position of the pushing-up plate by a mechanism that does not obtain power from an electric drive source.

6. The sheet material feeding device according to claim 1, wherein the rear-end displacement member displacing device changes the position of the rear-end displacement member by a mechanism that does not obtain power from an electric drive source.

7. The sheet material feeding device according to claim 1, wherein the pushing-up plate displacing device changes the position of the pushing-up plate to the retracted position when the cassette is pulled out of the housing.

8. The sheet material feeding device according to claim 1, wherein the rear-end displacement member displacing device changes the position of the rear-end displacement member to the retracted position when the cassette is pulled out of the housing.

9. The sheet material feeding device according to claim 1, wherein the rear-end displacement member displacing device comprises a first starting lever configured to change the position of the rear-end displacement member to the feeding position by coming into contact with the housing so as to be displaced when the cassette is stored in the housing.

10. The sheet material feeding device according to claim 1, wherein the pushing-up plate displacing device comprises a second starting lever configured to change the position of the pushing-up plate to the feeding position by coming into contact with the housing so as to be displaced when the cassette is stored in the housing.

11. The sheet material feeding device according to claim 10, wherein a first starting lever comes in contact with the housing before the second starting lever comes in contact with the housing.

12. The sheet material feeding device according to claim 10, wherein a first starting lever and the second starting lever are formed as a single member.

13. An image forming apparatus comprising:

the sheet material feeding device according to claim 1; and an image forming unit configured to form an image on a sheet supplied from the sheet material feeding device.

* * * * *